US007224333B2

(12) United States Patent
Yamazaki et al.

(10) Patent No.: US 7,224,333 B2
(45) Date of Patent: May 29, 2007

(54) DISPLAY DEVICE AND DRIVING METHOD THEREOF

(75) Inventors: Shunpei Yamazaki, Tokyo (JP); Mitsuaki Osame, Kanagawa (JP); Jun Koyama, Kanagawa (JP)

(73) Assignee: Semiconductor Energy Laboratory Co. Ltd., Kanagawa-ken (JP)

( * ) Notice: Subject to any disclaimer, the term of this patent is extended or adjusted under 35 U.S.C. 154(b) by 430 days.

(21) Appl. No.: 10/342,346

(22) Filed: Jan. 15, 2003

(65) Prior Publication Data

US 2003/0146888 A1 Aug. 7, 2003

(30) Foreign Application Priority Data

Jan. 18, 2002 (JP) ..... 2002-010883

(51) Int. Cl.
*G09G 3/32* (2006.01)

(52) U.S. Cl. ..... 345/82; 345/36; 345/76

(58) Field of Classification Search ..... 345/36, 345/45, 46, 48, 63, 64, 76, 77, 82, 84, 87
See application file for complete search history.

(56) References Cited

U.S. PATENT DOCUMENTS

| | | | | |
|---|---|---|---|---|
| 6,169,528 | B1 | 1/2001 | Oguchi et al. | |
| 6,339,414 | B1 | 1/2002 | Todokoro et al. | |
| 6,522,315 | B2 | 2/2003 | Ozawa et al. | |
| 6,531,996 | B1 | 3/2003 | Murade | |
| 6,731,266 | B1 | 5/2004 | Jung | |
| 6,774,574 | B1 | 8/2004 | Koyama | |
| 6,806,857 | B2 * | 10/2004 | Sempel et al. | 345/92 |
| 6,879,110 | B2 * | 4/2005 | Koyama | 315/169.1 |
| 6,903,731 | B2 * | 6/2005 | Inukai | 345/204 |
| 2001/0022565 | A1 | 9/2001 | Kimura | |
| 2002/0005696 | A1 | 1/2002 | Yamazaki et al. | |
| 2002/0024493 | A1 | 2/2002 | Ozawa et al. | |
| 2002/0041267 | A1 | 4/2002 | Jung | |

(Continued)

FOREIGN PATENT DOCUMENTS

EP 0-895-219 A1 2/1999

(Continued)

OTHER PUBLICATIONS

Notice from the Japanese Patent Office dated Apr. 12, 2005 corresponding to the instant Application.

(Continued)

*Primary Examiner*—Richard Hjerpe
*Assistant Examiner*—Jean Lesperance
(74) *Attorney, Agent, or Firm*—Nixon Peabody, LLP; Jeffrey L. Costellia

(57) ABSTRACT

In an active matrix EL display device, a drive mode is switched between constant voltage drive and constant current drive according to display contents. Whether an OLED is driven at constant current or driven at constant voltage is determined according to whether a driving TFT is driven in a saturation region or driven in a linear region. The separation between the saturation region and the linear region is determined according to a voltage applied to the gate of the TFT and a voltage applied to the OLED. By controlling those voltages, the constant voltage drive and the constant current drive can be separately used, thereby allowing a use in which respective advantages of the both drives are utilized.

94 Claims, 22 Drawing Sheets

U.S. PATENT DOCUMENTS

| | | | |
|---|---|---|---|
| 2002/0097213 | A1 | 7/2002 | Ozawa et al. |
| 2002/0153844 | A1 | 10/2002 | Koyama |
| 2003/0098827 | A1 | 5/2003 | Ozawa et al. |
| 2004/0150591 | A1 | 8/2004 | Ozawa et al. |

FOREIGN PATENT DOCUMENTS

| | | | |
|---|---|---|---|
| EP | 0 984 423 | A2 | 3/2000 |
| EP | 1-063-630 | A2 | 12/2000 |
| EP | 1-255-240 | A1 | 11/2002 |
| EP | 1-336-953 | A2 | 8/2003 |
| EP | 1-359-789 | A1 | 11/2003 |
| JP | 60-64395 | | 4/1985 |
| JP | 5-030351 | | 2/1993 |
| JP | 6-301353 | | 10/1994 |
| JP | 09-251277 | | 9/1997 |
| JP | 11-265162 | | 9/1999 |
| JP | 11-329721 | | 11/1999 |
| JP | 2000-56727 | | 2/2000 |
| JP | 2000-089194 | | 3/2000 |
| JP | 2000-221903 | A2 | 8/2000 |
| JP | 2000-235370 | | 8/2000 |
| JP | 2001-005426 | | 1/2001 |
| JP | 2001-343933 | A | 2/2001 |
| JP | 2001-109421 | | 4/2001 |
| JP | 2001-159878 | A | 6/2001 |
| JP | 2001-188504 | | 7/2001 |
| JP | 2001-228831 | | 8/2001 |
| JP | 2001-324958 | A | 11/2001 |
| WO | WO-98-36407 | | 8/1998 |

OTHER PUBLICATIONS

Notice from Japanese Patent Office dated Apr. 12, 2005 corresponding to instant U.S. Appl. No. 10/342,346.

* cited by examiner

Vgs(R):6. 47 V (G):3. 83 V (B):5. 65 V

DISPLAY DEVICE AND DRIVING METHOD THEREOF

BACKGROUND OF THE INVENTION

1. Field of the Invention

The present invention relates to a display device, and more particularly to an OLED display device using thin film transistors formed on a transparent substrate made of glass, plastic, or the like and a driving method thereof. In addition, the present invention relates to an electronic equipment using the display device.

2. Description of the Related Art

In recent years, a mobile telephone is widely available as communication technology develops. In the future, moving picture transmission and a larger amount of information transfer are further expected. With respect to a personal computer, products for mobile applications are manufactured due to a reduction in weight thereof. A large number of information devices which are called personal digital assistants (PDAs) starting with an electronic notebook are also manufactured and becoming widely available. In addition, with the development of display devices and the like, the majority of portable information devices are equipped with a flat display.

Further, according to recent techniques, those information devices tend to use an active matrix display device as a display device used therefor.

According to the active matrix display device, a TFT (thin film transistor) is located in each pixel and a screen is controlled by the TFTs. Such an active matrix display device has advantages in that it achieves higher definition and improved image quality and can handle moving pictures, as compared with a passive matrix display device. Thus, in the future, it is considered that a display device for the portable information device will be changed from the passive matrix type to the active matrix type.

Also, of active matrix display devices, in recent years, a display device using low temperature polysilicon is commercially available. According to a low temperature polysilicon technique, in addition to a pixel TFT composing a pixel, a driver circuit can be simultaneously formed using TFTs in a peripheral region of a pixel portion so that it makes a significant contribution to miniaturization of the device and reduction in consumption power thereof. Accordingly, in recent years, the low temperature polysilicon display device is becoming an essential device for the display portion or the like of a mobile device whose application fields are expanding remarkably.

Also, in recent years, a display device using an organic electroluminescent element (OLED) is actively developed. Here, assume that an OLED includes both of an element utilizing light emission (fluorescence) from singlet exciton and an element utilizing light emission (phosphorescence) from triplet exciton. In this specification, the OELD is indicated as an example of a light emitting element. However, another light emitting element may be used.

The OLED is composed of a pair of electrodes (cathode and anode) and an OLED layer sandwiched therebetween and a laminate structure is generally used. Typically, there is a laminate structure (hole transporting layer, light emitting layer, and electron transporting layer) proposed by Tang, Eastman Kodak Company.

In addition to such a structure, there is a structure in which (a hole injection layer, a hole transporting layer, a light emitting layer, and an electron transport layer) or (a hole injection layer, a hole transporting layer, a light emitting layer, an electron transport layer, and an electron injection layer) are laminated in the stated order. In the present invention, any of those structures may be employed. In addition, the light emitting layer may be doped with a fluorescent pigment.

In this specification, all layers provided between the anode and the cathode are generically called an OLED layer. Thus, the hole injection layer, the hole transporting layer, the light emitting layer, the electron transport layer, and the electron injection layer all are included in the OLED layer. A light emitting element composed of the anode, the OLED layer, and the cathode is called an OLED.

FIG. 2 shows a structural example of a pixel portion of an active matrix OLED display device. Gate signal lines (G1 to Gy) to which a selection signal is inputted from a gate signal line driver circuit each are connected with the gate electrode of a switching TFT 201 in each pixel. Also, with respect to the source region and the drain region of the switching TFT 201 in each pixel, one is connected with one of source signal lines (S1 to Sx) to which a signal is inputted from a source signal line driver circuit, and the other is connected with the gate electrode of an OLED driving TFT 202 and one electrode of a capacitor 203 in each pixel. The other electrode of the capacitor 203 is connected with one of power supply lines (V1 to Vx). With respect to the source region and the drain region of the OLED driving TFT 202 in each pixel, one is connected with one of the power supply lines (V1 to Vx), and the other is connected with one electrode of an OLED 204 in each pixel.

The OLED 204 has an anode, a cathode, and an OLED layer provided between the anode and the cathode. When the anode of the OLED 204 is connected with the source region or the drain region of the OLED driving TFT 202, the anode of the OLED 204 becomes a pixel electrode and the cathode thereof becomes a counter electrode. Conversely, when the cathode of the OLED 204 is connected with the source region or the drain region of the OLED driving TFT 202, the cathode of the OLED 204 becomes a pixel electrode and the anode thereof becomes a counter electrode.

Note that a potential on the counter electrode is called a counter potential in this specification. A power source for providing the counter potential to the counter electrode is called a counter power source. A potential difference between a potential on the pixel electrode and a potential on the counter electrode is an OLED drive voltage. The OLED drive voltage is applied to the OLED layer.

Note that in this specification, the switching TFT is an N-channel TFT and the driving TFT is a P-channel TFT. In addition, with respect to the electrodes of the OLED, one connected with the driving TFT is assumed as an anode and the other is assumed as a cathode. However, this does not mean that a combination other than the above cannot be realized. Therefore, other combinations are also possible.

With respect to a gradation display method for the above OLED display device, there are a constant current analog gradation method and a constant voltage time gradation method. In addition to them, there is a constant current time gradation method. Here, the above two types will be described. With respect to the definition of words, "constant current drive" means that the device is driven at a constant current during a period for which a video is held, such as one frame period and does not mean that the device is always driven at the same current. The same is applicable to the term "constant voltage drive". FIG. 10A is a conceptual diagram showing the constant current drive and FIG. 10B is a conceptual diagram showing the constant voltage drive. According to the constant current drive, the OLED driving TFT is used as a voltage control type current source and a gate voltage of the driving TFT is controlled to flow a necessary current into the OLED. The constant voltage drive is a drive method in which the OLED driving TFT is used as a switch and the power supply line and the OLED are short-circuited when necessary to emit light from the OLED.

First, the constant current analog gradation method for the OLED display device will be described. FIG. 3 is a block diagram of a constant current analog gradation type display device. In addition, FIG. 4 is its timing chart. Hereinafter, a description will be made using FIG. 3. First, when a gate start pulse GSP and a gate clock pulse GCL are inputted to a shift register 304, a shift pulse is formed in the shift register 304. The shift pulse is outputted to a gate signal line through a buffer circuit 305. The gate signal lines are selected in succession according to the shift pulse. While the gate signal line is selected, a source start pulse SSP and a source clock pulse SCL are inputted to a shift register 302 of a source signal line driver circuit. Thus, a shift pulse is formed in the source shift register 302 and outputted to control terminals of analog switches 312 and 313 though a buffer circuit 303. When the analog switches 312 and 313 are selected in succession, an analog video signal line 314 and source signal lines 306 and 307 are short-circuited in succession so that analog video signals are sampled in succession for the source signal lines. The sampled analog video signals each are inputted to the gate of the OLED driving TFT through one of the source signal lines 306 and 307 and the switching TFT in each pixel.

As described above, the amount of light emission of the OLED is controlled according to the analog video signal, and gradation display is conducted by controlling the amount of light emission. Thus, according to the constant current analog gradation method, the gradation display is conducted according to a change in potential of the analog video signal inputted to the source signal line.

In the constant current analog drive in which a drain current corresponding to Vgs flows into a driving TFT, a TFT is generally operated in a saturation region. FIG. 5A shows the operation of the TFT. The saturation region is a region indicating Vds>Vgs, a region in which a change in drain current is small as compared with a change in Vds. This region is used as a pseudo constant current.

Next, the constant voltage time gradation method will be described. According to the time gradation method, a digital signal is inputted to a pixel to select a light emitting state or a non-light emitting state of the OLED, and the gradation is represented according to the accumulating total of OLED light emitting periods per frame period. Note that the principle of time gradation is described in JP 2001-159878 A.

FIG. 7 is a block diagram of a display device 701 using the constant voltage time gradation method. In addition, FIG. 8 is its timing chart. Hereinafter, a description will be made with reference to FIG. 7. The gate signal line driver circuit is the same as in the case of the analog gradation drive and therefore the description is omitted here. A source signal line driver circuit is composed of a shift register circuit 702, a buffer circuit 703, a first latch circuit 704, and a second latch circuit 705. A source start pulse SSP and a source clock pulse SCL are inputted to the shift register circuit 702. The shift register circuit forms a shift pulse in response to those pulses. The shift pulse is inputted to the first latch circuit 704 through the buffer circuit 703. When the shift pulse is inputted to the first latch circuit, the first latch circuit latches a digital gradation signal. When a shift of one line is completed, digital video data corresponding to one line is stored in the first latch circuit 704. During a retrace period after that, a latch pulse is inputted to the second latch circuit 705. In response to the latch pulse, the digital video data stored in the first latch circuit 704 is transferred to the second latch circuit 705 and outputted to source signal lines 708 and 709. Then, video data corresponding to a next line is stored in the first latch circuit 704. Such operation is repeated so that digital video data is outputted to the source signal lines 708 and 709 in succession.

With respect to the conventional OLED display device as described above, there are the following problems.

First, in the constant current analog drive type display device, as described above, voltage-current conversion is conducted by the OLED driving TFT. Thus, when mobility and a threshold value of the TFT are varied, these variations cause a variation in drain current. Therefore, when an in-plane variation of the TFT is large, it appears as display nonuniformity. For example, if the mobility of the TFT is varied by 10%, luminous intensity is also varied by 10%. In addition, the threshold value is varied by 0.1 V, this also results in a luminous intensity variation of about 10%. As for the threshold and the mobility, these have independent variations, thereby causing a variation of about 14% in total. Accordingly, establishment of a method for alleviating variations in TFT characteristics is desired. The problem described above is described in JP 2000-221903 A and the like.

On the other hand, in the constant voltage time gradation drive, the influence of a variation in TFTs on display is small. When the TFT is operated in a linear region, the term of the threshold value is a first power term and Vgs is set large. Thus, even if there is a variation of 0.1 V in threshold value, a luminous intensity variation of only about 1% is caused. In addition, even if a variation in mobility is 10%, negative feedback is generated between Vgs and a forward direction voltage of the OLED. Therefore, a variation in current is suppressed to be reduced to 5% or less.

However, in the constant voltage time gradation drive, there is a problem such as deterioration of the OLED with time. A change in OLED with time will be described with reference to FIGS. 12A and 12B. When the OLED is driven, two deterioration phenomena appear. A first deterioration phenomenon is a reduction in intensity. FIG. 12A shows its example. A light emission intensity of the OLED is reduced with time. A period of time until when the intensity is reduced by half is assumed as a life time. The life time depends on the intensity but is at present generally 1000 hours to several 1000 hours at about 200 cd/m$^2$. As shown in FIG. 12B, when the deterioration is caused, a slope of a current-intensity characteristic is reduced.

Also, a second deterioration phenomenon is an increase in forward direction voltage. As shown in FIG. 13A, when the same current continuously flows, the forward direction voltage is being increased. FIG. 13B shows a voltage-current characteristic. As shown in FIG. 13B, the characteristic is shifted from the left to the right before and after the deterioration. FIGS. 9A to 9C show changes in operating point of the constant current drive and that of the constant voltage drive. According to the constant current drive, only in the former case of a reduction in light emission efficiency, the deterioration appears on display. As shown in FIG. 9A, when there is a sufficient margin for Vds of a TFT, an increase in forward direction voltage of the OLED is absorbed thereby so that it does not appear on display. On the other hand, as shown in FIG. 9B, according to the constant voltage drive, an increase in forward direction voltage causes an increase in value of current change ΔI. In the case of the constant voltage drive, an effect of both a decrease in current and a reduction in light emission efficiency is caused. Thus, there is a problem that the deterioration appears to increase.

In a display device, a light emission time of a pixel is changed according to a location. With respect to a location such as a position of an icon, a cumulative light emission time is long so that rapid deterioration is caused. When the entire surface of a screen is displayed at uniform luminous intensity, the luminous intensity is reduced in a location where the deterioration is rapid. Thus, there is a problem that only such a portion is sensed as burn-in.

SUMMARY OF THE INVENTION

In order to solve the above described problems, according to the present invention, the following means is used.

The present invention is characterized in that switching between drive modes such as constant voltage drive and constant current drive is performed according to display contents to select a display mode suitable to the display contents.

As a display object of an OLED display device, there is, for example, a mobile telephone. Conventionally, mobile telephones have been required to only display character information. However, with the progress of communication technologies, transmission of moving pictures is also becoming possible. Thus, in the mobile telephone, two types of data, that is, character information such as a telephone number and an electronic mail and a natural picture are used.

Of the above described problems, the burn-in is in many cases caused in a region where a fixed pattern is continuously displayed. The burn-in is liable to occur in an object such as an icon. Such a pattern may be generated in the case of displaying character information. When a natural picture is displayed in a state in which the burn-in is being caused, an icon is left as an image in only such a region, thus giving a user an uncomfortable feeling.

Also, of the above mentioned problems, display nonuniformity markedly appears on the entire solid pattern. In the case of a video of character information close to such a pattern, a user has an uncomfortable feeling. On the other hand, when a natural image is displayed, since an original video is not uniform, the nonuniformity is not conspicuous and hence it rarely gives an uncomfortable feeling. Thus, when the character information is to be displayed, the constant voltage drive is preferable. On the other hand, when the natural picture is to be displayed, the constant current drive is preferable.

According to the present invention, the drive mode is switched between the constant current drive and the constant voltage drive according to display contents so that drawbacks of both the drives are compensated for.

Note that the present invention can be applied not only to a display device using the OLED but also to a display device using another light emitting element. For example, the present invention can be used for a display device to which a light emitting element in which an inorganic material is contained in a hole injection layer, a hole transporting layer, an electron injection layer, and an electron transporting layer is applied.

One of the features of the present invention is that a display device in which a plurality of pixels, a plurality of source signal lines, and a plurality of gate signal lines are arranged in matrix on a substrate, each of the pixels having an OLED, the device comprises means for switching between a first drive mode for driving the OLED at a constant current and a second drive mode for driving the OLED at a constant voltage.

Another of the features of the present invention is that a display device in which a plurality of pixels, a plurality of source signal lines, and a plurality of gate signal lines are arranged in matrix on a substrate, each of the pixels having an OLED, at least one switching TFT, and at least one OLED driving TFT, the device comprises means for switching between a first drive mode for driving the OLED driving TFT in a saturation region and a second drive mode for driving the OLED driving TFT in a linear region.

Also, another of the features of the present invention is that a display device in which a plurality of pixels, a plurality of source signal lines, and a plurality of gate signal lines are arranged in matrix on a substrate, each of the pixels having an OLED, at least one switching TFT, and at least one OLED driving TFT, the device comprises means for switching among a first drive mode for driving the OLED driving TFT in a saturation region, a second drive mode for driving the OLED driving TFT in a linear region, and a third drive mode for driving the OLED driving TFT in a middle region between the linear region and the saturation region.

According to the above features, the first drive mode is analog current drive.

Also, according to the above features, the first drive mode is digital time gradation.

According to the above features, the second drive method is digital time gradation.

According to the above features, a potential change for drive mode switching is controlled by an external circuit.

According to the above features, a potential change for drive mode switching is controlled by an external DA converting circuit.

Also, a display module and an electronic equipment can be obtained by using a display device according to the above features.

Another of the features of the present invention is that a method of driving a display device in which a plurality of pixels, a plurality of source signal lines, and a plurality of gate signal lines are arranged in matrix on a substrate, each of the pixels having an OLED, the method comprises driving the display device by switching between a first drive method for driving the OLED at a constant current and a second drive method for driving the OLED at a constant voltage.

Another of the features of the present invention is that a method of driving a display device in which a plurality of pixels, a plurality of source signal lines, and a plurality of gate signal lines are arranged in matrix on a substrate, each of the pixels having an OLED, at least one switching TFT, and at least one OLED driving TFT, the method comprises driving the display device by switching between a first drive method for driving the OLED driving TFT in a saturation region and a second drive method for driving the OLED driving TFT in a linear region.

Also, another of the features of the present invention is that a method of driving a display device in which a plurality of pixels, a plurality of source signal lines, and a plurality of gate signal lines are arranged in matrix on a substrate, each of the pixels having an OLED, at least one switching TFT, and at least one OLED driving TFT, the method comprises driving the display device by switching among a first drive method for driving the OLED driving TFT in a saturation region, a second drive method for driving the OLED driving TFT in a linear region, and a third drive method for driving the OLED driving TFT in a middle region between the linear region and the saturation region.

According to the above features, the first drive method is a method using analog current drive.

According to the above features, the first drive method is a method using digital time gradation.

According to the above features, the second drive method is a method using digital time gradation.

Also, it can be obtained a display module and electronic equipment using a method of driving a display device according to the above features.

Another of the features of the present invention is that a display device in which a plurality of pixels, a plurality of source signal lines, and a plurality of gate signal lines are arranged in matrix on a substrate, each of the pixels having a light emitting element, the device comprises means for switching between a first drive mode for driving the light emitting element at a constant current and a second drive mode for driving the light emitting element at a constant voltage.

Another of the features of the present invention is that a display device in which a plurality of pixels, a plurality of source signal lines, and a plurality of gate signal lines are arranged in matrix on a substrate, each of the pixels having a light emitting element, at least one switching TFT, and at least one light emitting element driving TFT, the device comprises means for switching between a first drive mode for driving the light emitting element driving TFT in a saturation region and a second drive mode for driving the light emitting element driving TFT in a linear region.

Another of the features of the present invention is that a display device in which a plurality of pixels, a plurality of source signal lines, and a plurality of gate signal lines are arranged in matrix on a substrate, each of the pixels having a light emitting element, at least one switching TFT, and at least one light emitting element driving TFT, the device comprises means for switching among a first drive mode for driving the light emitting element driving TFT in a saturation region, a second drive mode for driving the light emitting element driving TFT in a linear region, and a third drive mode for driving the light emitting element driving TFT in a middle region between the linear region and the saturation region.

According to the above features, the first drive mode is analog current drive.

According to the above features, the first drive mode is digital time gradation.

According to the above features, the second drive mode is digital time gradation.

According to the above features, a potential change for drive mode switching is controlled by an external circuit.

According to the above features, a potential change for drive mode switching is controlled by an external DA converting circuit.

Also, a display module and an electronic equipment can be obtained by using a display device according to the above features.

Another of the features of the present invention is that a method of driving a display device in which a plurality of pixels, a plurality of source signal lines, and a plurality of gate signal lines are arranged in matrix on a substrate, each of the pixels having a light emitting element, the method comprises driving the display device by switching between a first drive method for driving the light emitting element at a constant current and a second drive method for driving the light emitting element at a constant voltage.

Another of the features of the present invention is that a method of driving a display device in which a plurality of pixels, a plurality of source signal lines, and a plurality of gate signal lines are arranged in matrix on a substrate, each of the pixels having a light emitting element, at least one switching TFT, and at least one light emitting element driving TFT, the method comprises the display device by switching between a first drive method for driving the light emitting element driving TFT in a saturation region and a second drive method for driving the light emitting element driving TFT in a linear region.

Another of the features of the present invention is that a method of driving a display device in which a plurality of pixels, a plurality of source signal lines, and a plurality of gate signal lines are arranged in matrix on a substrate, each of the pixels having an light emitting element, at least one switching TFT, and at least one light emitting element driving TFT, the method comprises the display device by switching among a first drive method for driving the light emitting element driving TFT in a saturation region, a second drive method for driving the light emitting element driving TFT in a linear region, and a third drive method for driving the light emitting element driving TFT in a middle region between the linear region and the saturation region.

According to the above features, the first drive method is a method using analog current drive.

According to the above features, the first drive method is a method using digital time gradation.

According to the above features, the second drive method is a method using digital time gradation.

Also, it can be obtained a display module and electronic equipment using a method of driving a display device according to the above features.

DETAILED DESCRIPTION OF THE PREFERRED EMBODIMENTS

An OLED display device of the present invention will be described.

Figure 1:
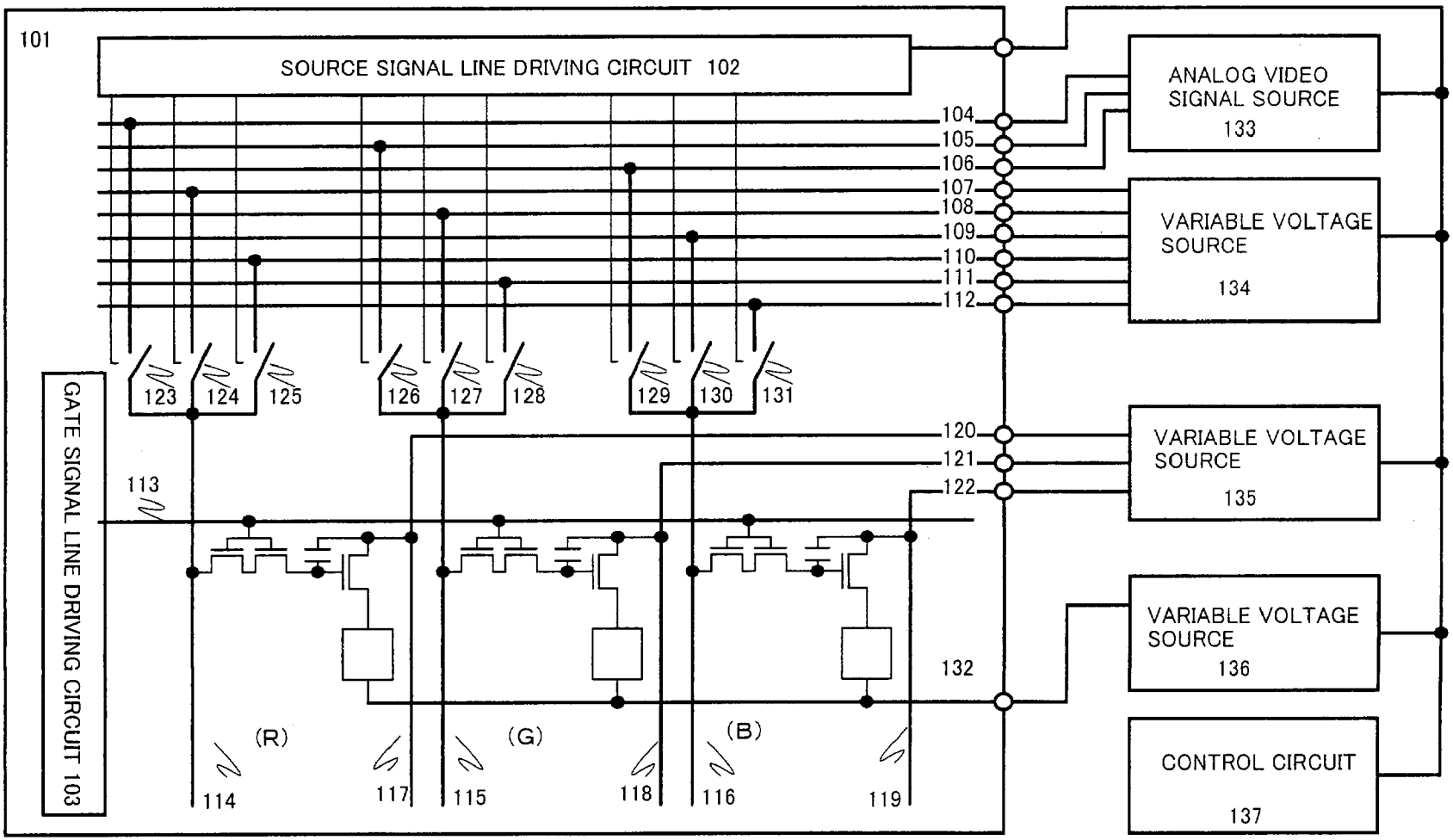
FIG. 1 is a block diagram showing a configuration of a display device of the present invention.
Figure 2:
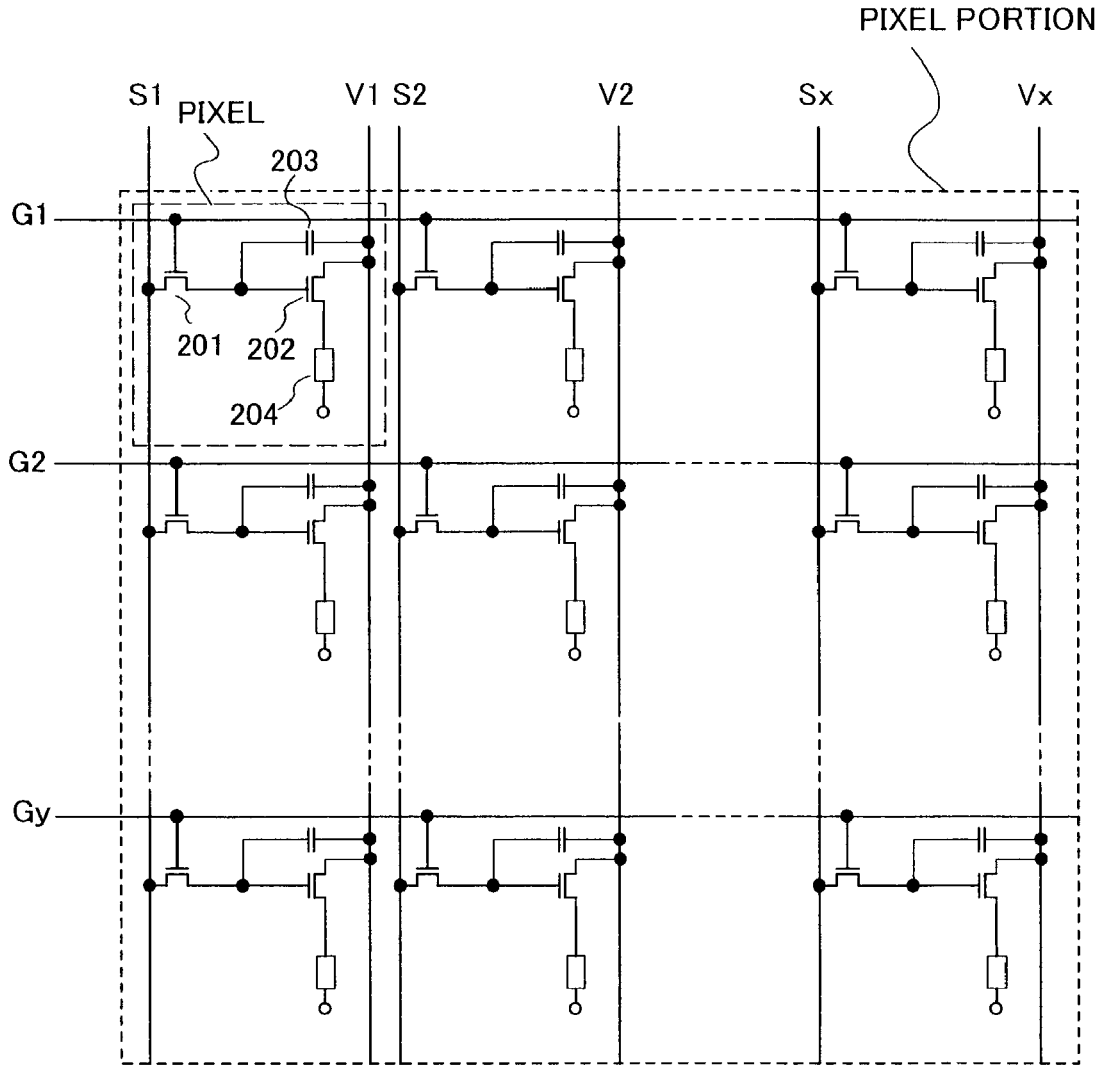
FIG. 2 is a block diagram showing a pixel configuration of a conventional display device.
Figure 3:
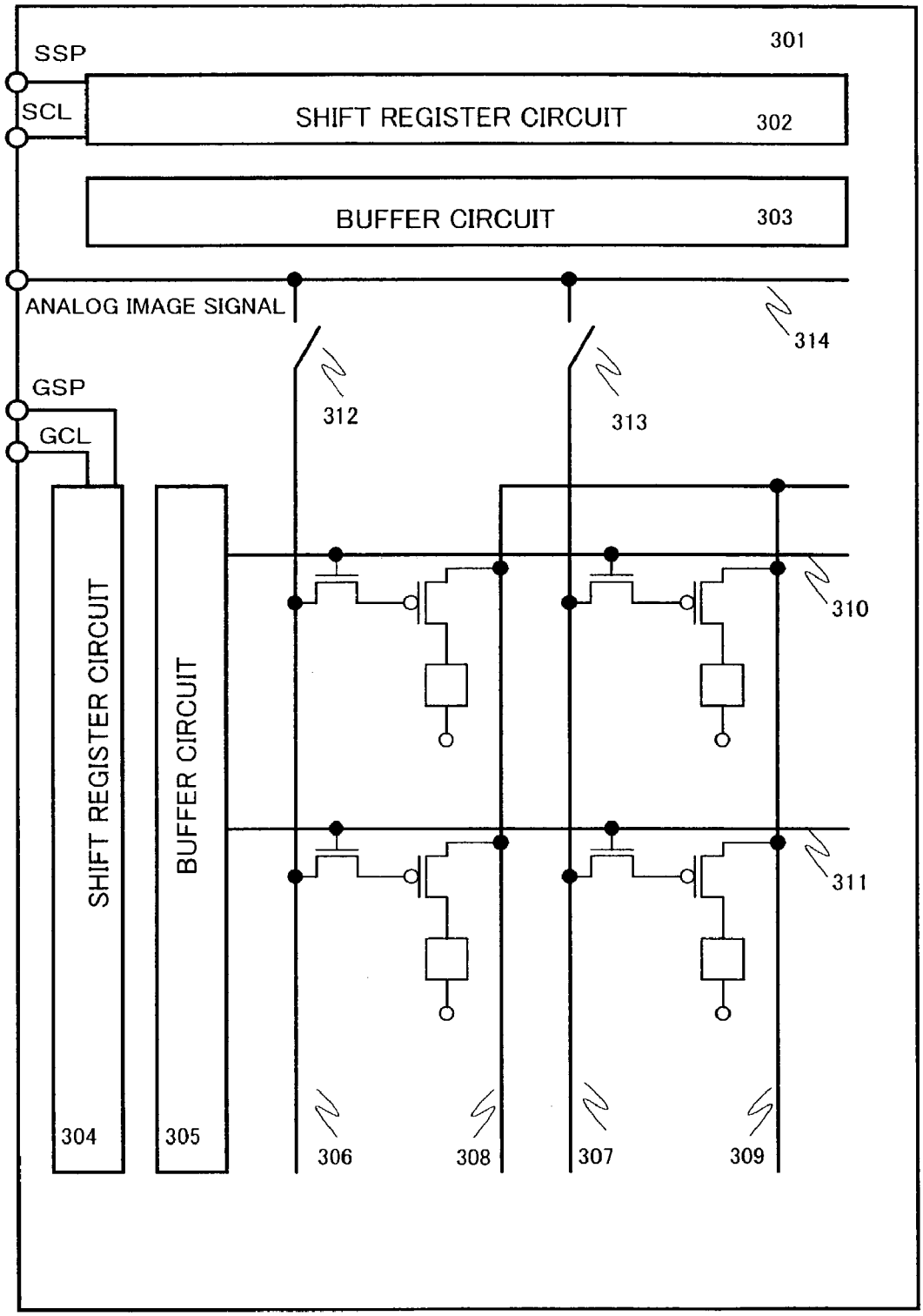
FIG. 3 shows a configuration of a conventional analog gradation display device.
Figure 4:
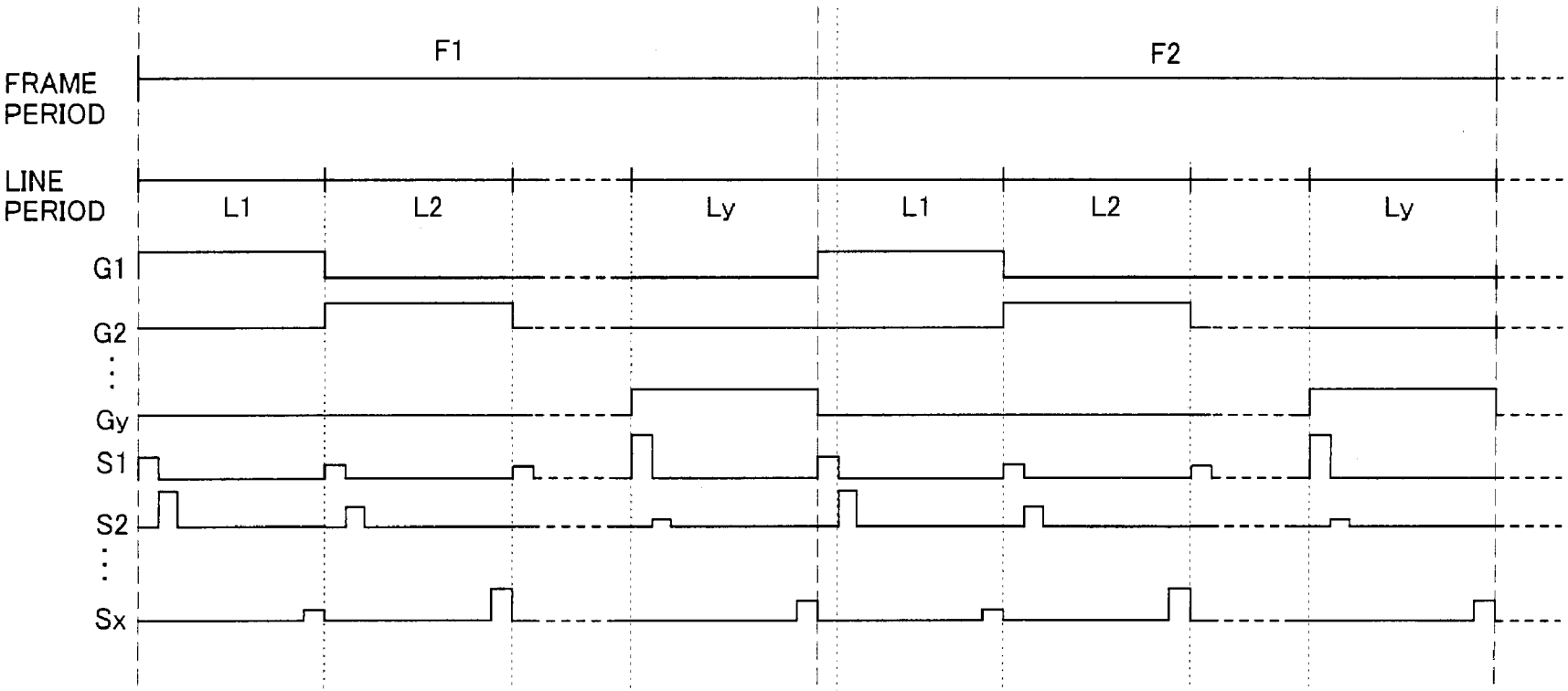
FIG. 4 is a timing chart for the conventional analog gradation display device.

FIG. 1 shows an embodiment mode of the present invention. According to this example, a drive method is switched between two drive methods, that is, constant current analog gradation drive or constant voltage time gradation drive, by changing external power sources of a display device 101. A control circuit 137 controls an analog video signal source 133, variable voltage sources 134, 135, and 136, and a source signal line driver circuit 102.

Figure 6:
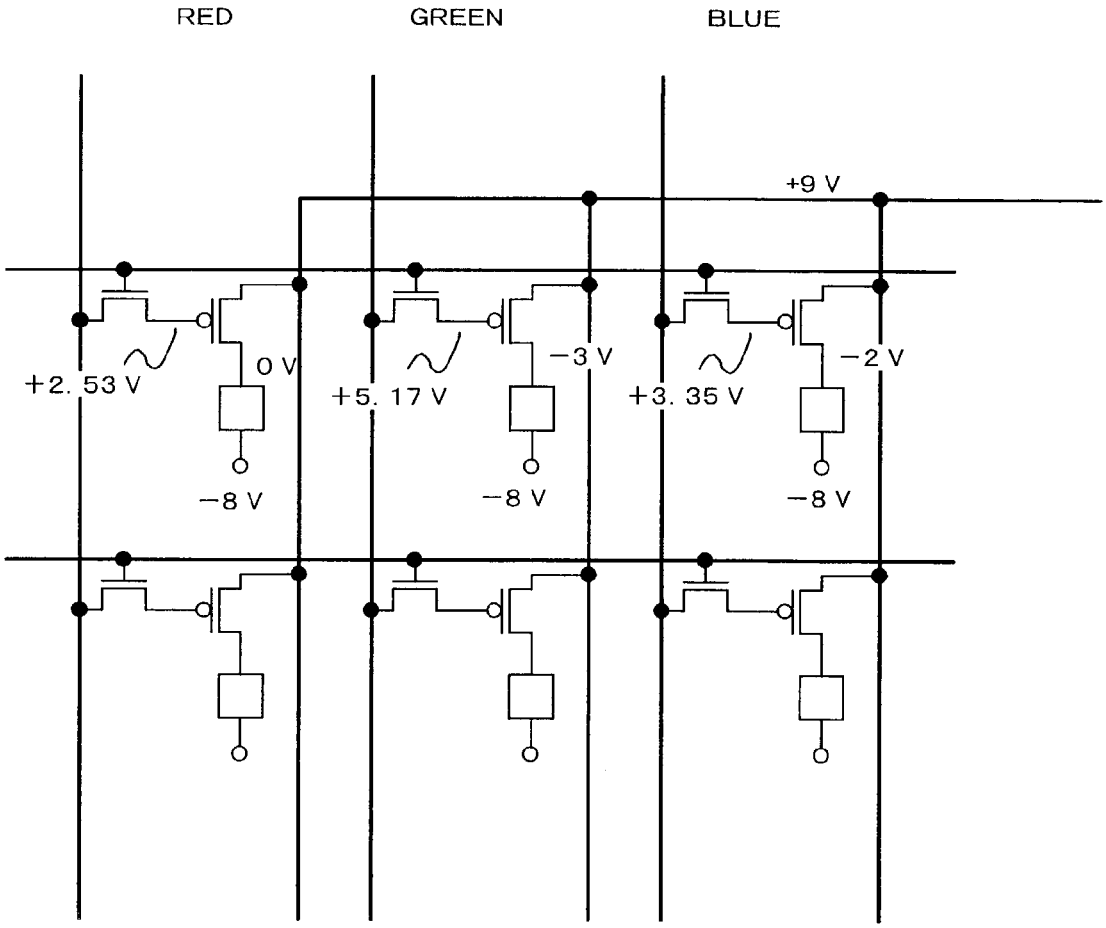
FIG. 6 shows a potential relationship of analog gradation drive.
Figure 7:
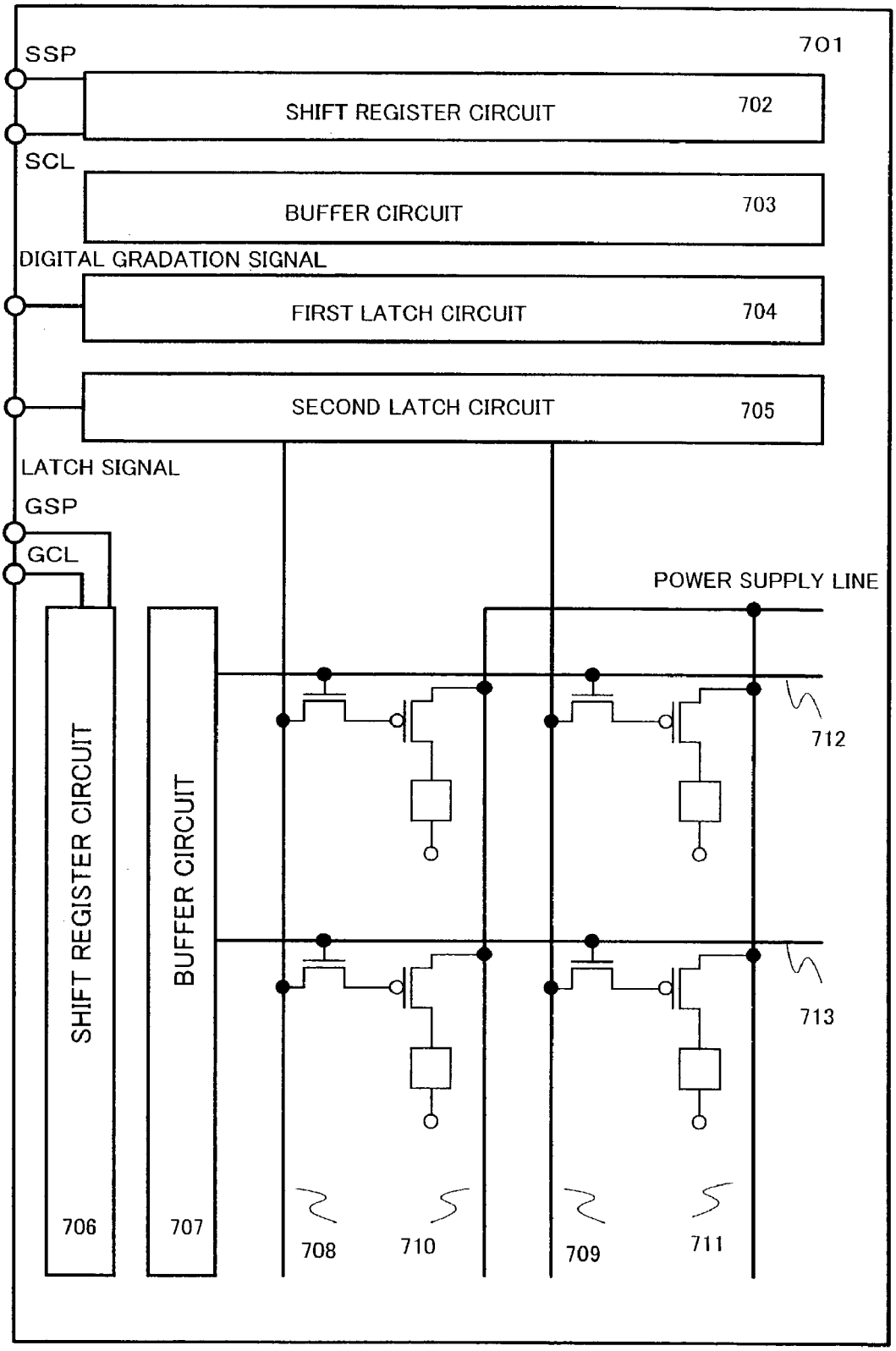
FIG. 7 shows a configuration of a conventional time gradation display device.
Figure 8:
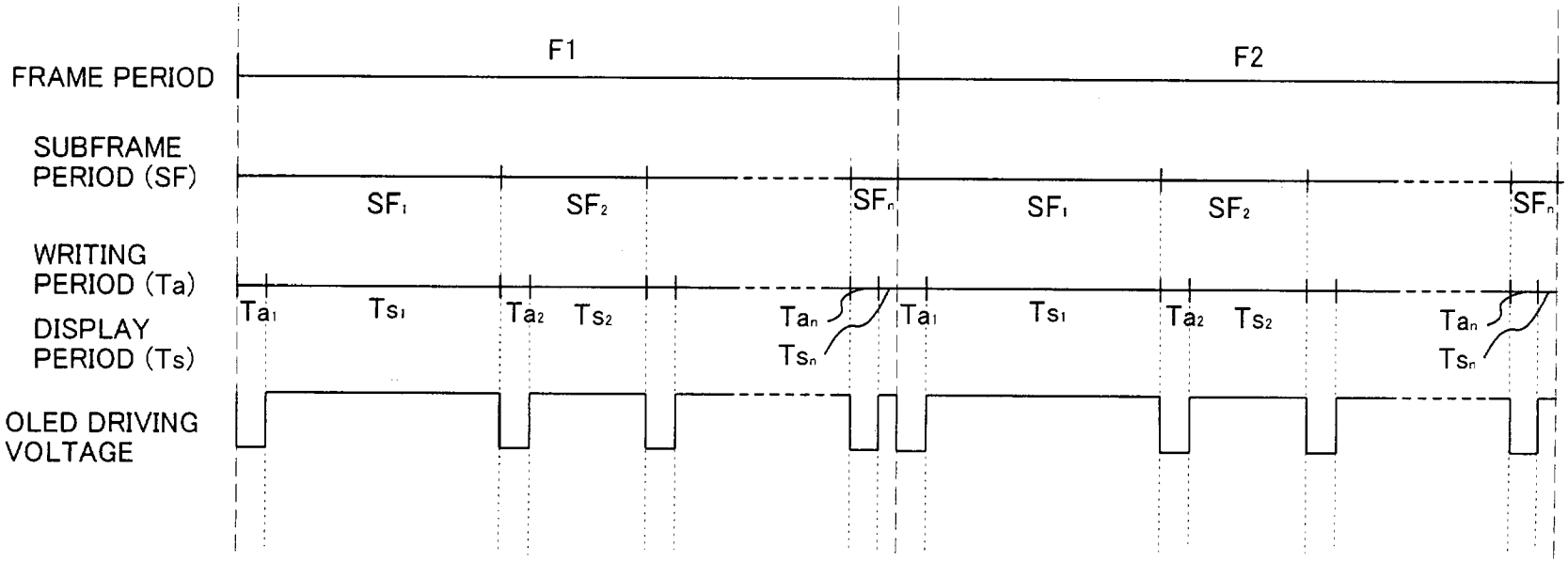
FIG. 8 is a timing chart for the conventional time gradation display device.
Figure 9C:
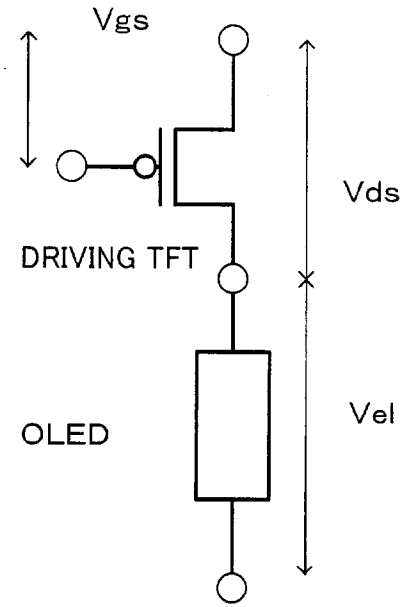
FIGS. 9A to 9C are explanatory diagrams of operating points of an OLED before and after deterioration.
Figure 9B:
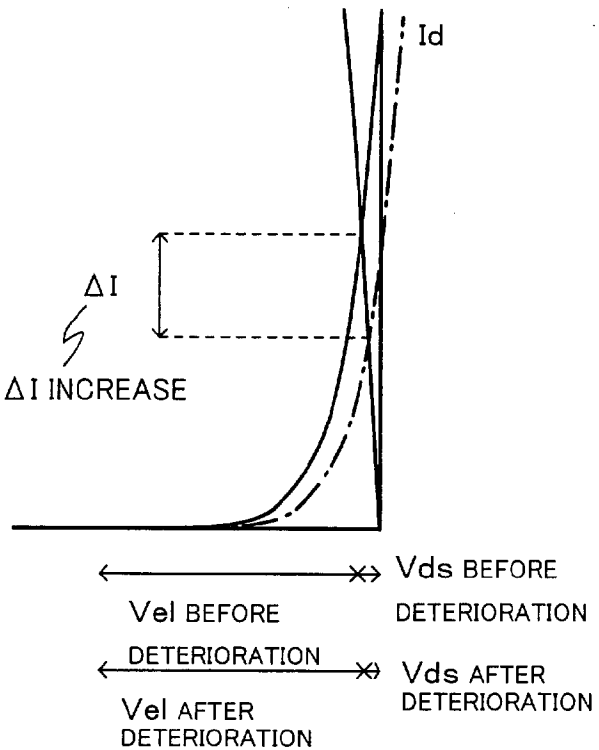
Figure 9A:
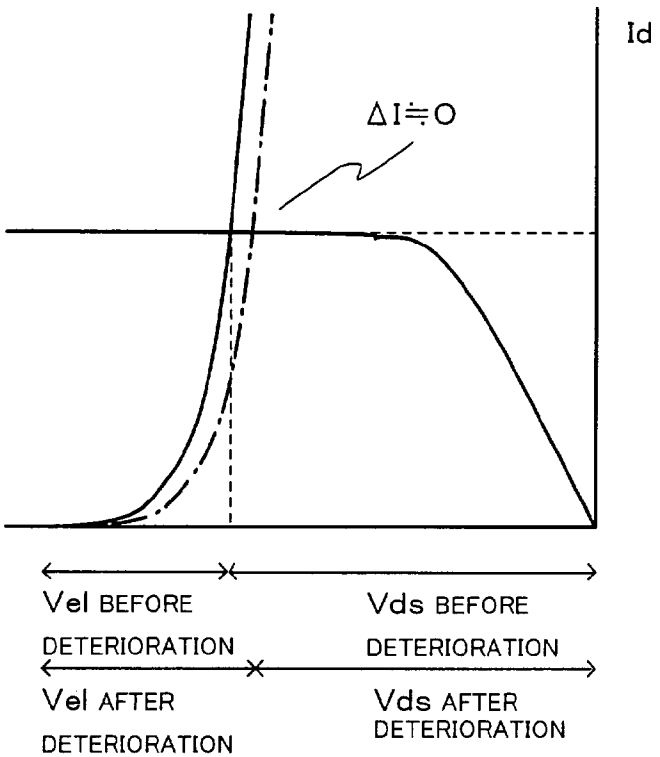
Figure 10A:
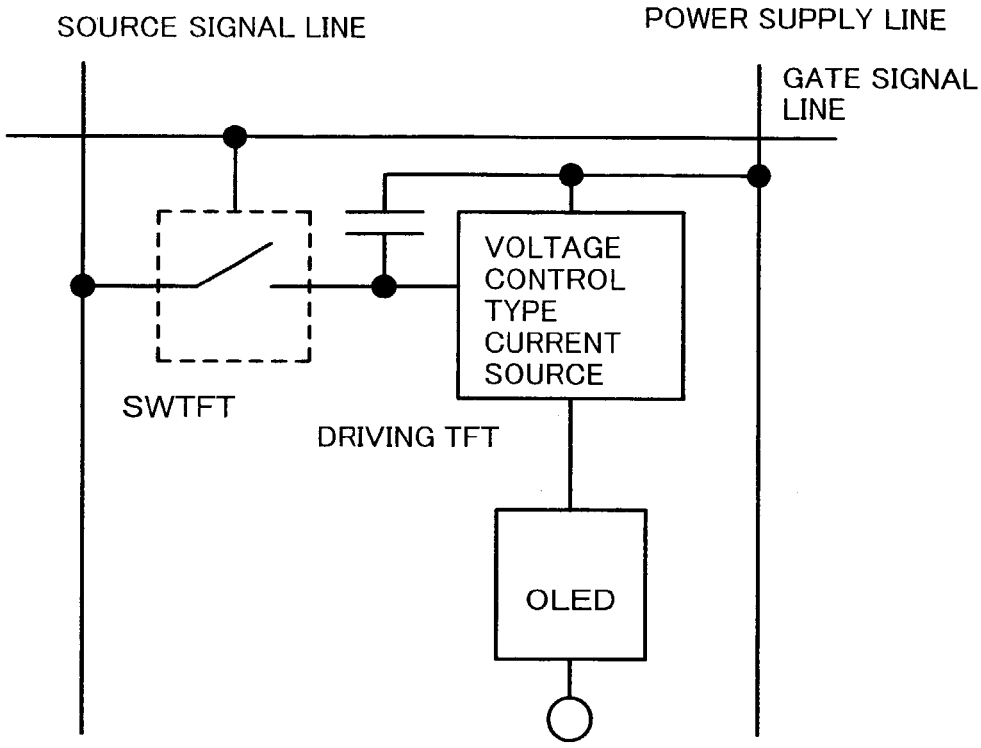
FIGS. 10A and 10B are conceptual diagrams for constant current drive and constant voltage drive.
Figure 10B:
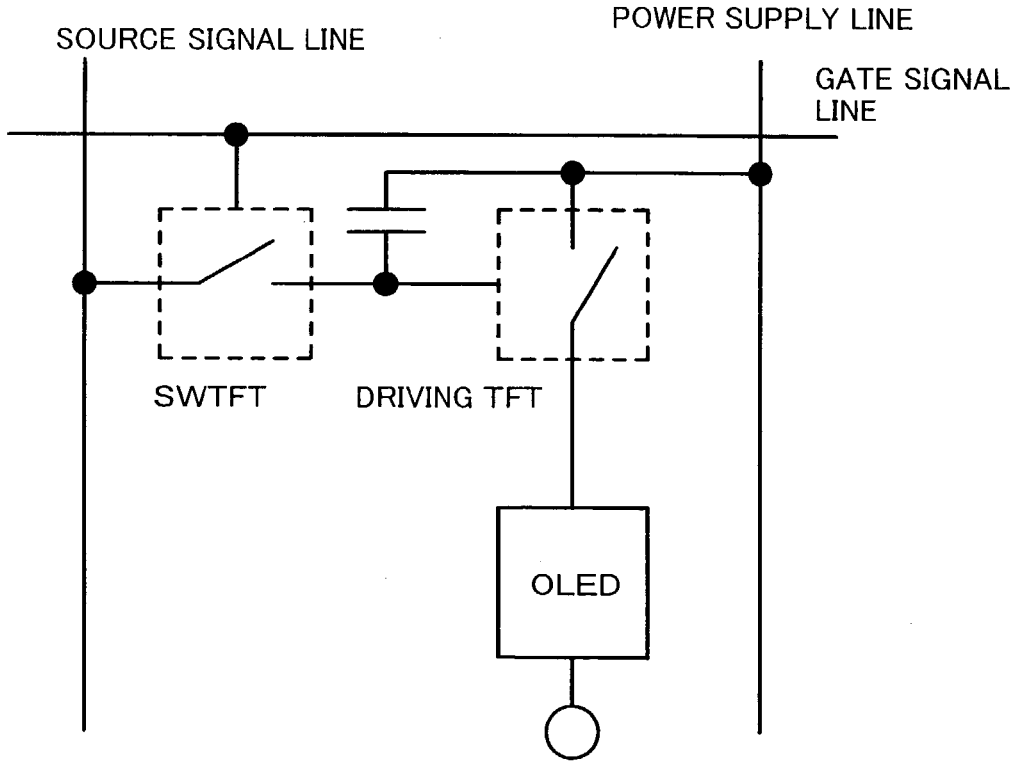

First, a specific voltage relationship of the constant current analog gradation drive will be described. In a full color OLED display device, OLED materials of three colors of red, green, and blue are separately applied according to a pitch of a pixel to conduct color display. With respect to the OLED materials of three colors, their characteristics differ according to color. In general, when low molecular OLED materials are used, light emission efficiency of a green material is the highest, that of a blue material comes next, and that of a red material is the lowest. More specifically, when a luminous intensity of 200 cd/$m^2$ is to be obtained in an OLED display device of about 150 ppi, it is necessary to flow currents of about 3 μA, about 0.5 μA, and about 2 μA into the red material, the green material, and the blue material of each pixel, respectively. In addition, the respective forward direction voltages become about 8 V, about 5 V, and about 6 V FIG. 6 shows a potential relationship in the case where the constant current analog gradation drive is conducted. Cathodes of OLEDs are commonly connected with each other. When the potential is set to −8 V, potentials of the anodes for respective colors become 0 V, −3 V, and −2 V.

Also, Vgs of a TFT is obtained by an equation indicating a saturation region of the TFT (equation 1).

$$Id=\tfrac{1}{2}\cdot\mu\cdot Co\cdot W/L\cdot(Vgs-Vth)^2 \quad (1)$$

Here, with respect to specifications of an OLED driving TFT, when mobility μ is given as 100 $cm^2$/Vs, a threshold voltage Vth is given as −2 V, a gate capacitance per unit area Co is given as $3\times10^{-8}$ F/$cm^2$, a gate length L of a transistor is given as 50 μm, and a gate width W thereof is given as 5 μm, Vgs corresponding to a current value per pixel as described above become 6.47 V, 3.83 V, and 5.65 V for respective colors. Taking the red color with the highest potential as a reference, first, when a margin for ensuring an operating region of the TFT in a saturation region is set to about 2.5 V, it is required that a gate potential of the OLED driving TFT connected with a red OLED is set to about +2.5 V. Thus, a source potential of the OLED driving TFT which drives the red OLED becomes about +9 V.

Considering a reduction in power consumption, it is preferable that the source potential is independently set for each color. However, it is general that a power source is commonly used. Thus, the source potential is adjusted to +9 V in red, the gate potential is given as +5.17 V in green and +3.35 V in blue so that potential setting is conducted. Therefore, the operation of the OLED driving TFT in the saturation region is ensured for all those colors. Because of the analog drive, a potential applied to the gate of each OLED driving TFT is changed to a video signal. When the above current value is set as a maximum value, of course, saturation region operation is also ensured.

When the constant current analog gradation drive is conducted, the variable voltage source 135 outputs a voltage of +9 V to respective power source supply lines 120, 121, and 122 for red, green, and blue. This value is the same value as shown in FIG. 6. Here, a potential on the power source supply lines 120, 121, and 122 is made common but may be independently set for reduced power consumption. In addition, the variable voltage source 136 outputs −8 V to the cathode. This value is the same value as shown in FIG. 6. The variable voltage source 134 is not used for the constant current analog gradation drive so that it may be made to an off state.

Then, analog video signals from the analog video signal source are inputted to analog video signal lines 104, 105, and 106. Analog switches 123, 126, and 129 are turned on in response to the outputs of the source signal line driver circuit 102 so that the analog video signals are sampled to source signal lines 114, 115, and 116. A potential on the respective source signal lines is applied to the gate of the OLED driving TFT and a storage capacitor through a switching TFT in a pixel to flow a current corresponding to Vgs of the OLED driving TFT into the OLED. In addition, in this embodiment, a double gate TFT is used as the switching TFT in order to reduce an off current of the switching TFT. The present invention is not limited to the double gate structure, and a triple or more gate structure may be used. Insofar as a TFT having a small off current can be produced, a single gate structure may also be used. In this way, the constant current analog gradation drive is conducted.

Figure 5C:
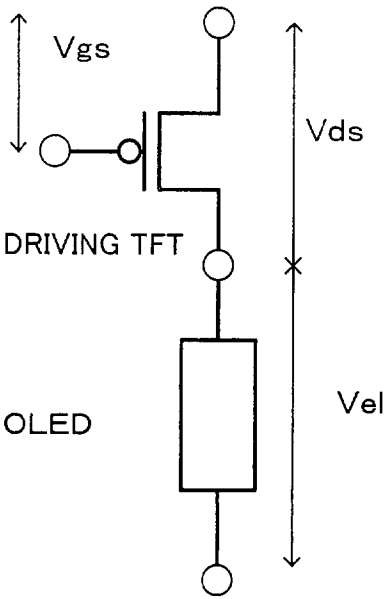
FIGS. 5A to 5C are explanatory diagrams of operating points of an OLED and a driving TFT.
Figure 5B:
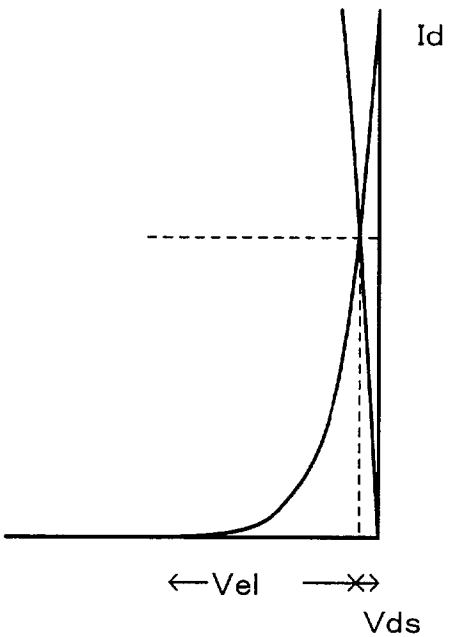
Figure 5A:
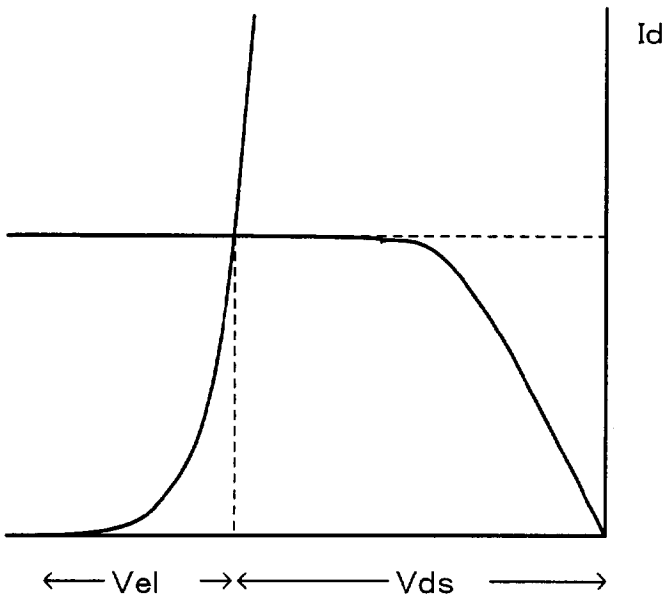

Next, the case of the constant voltage time gradation drive will be described. Analog video signals are not used in the constant voltage time gradation. Thus, the analog video signal source 133 may be made to an off state. A potential relationship in the case where the constant voltage digital time gradation is conducted will be first described using FIG. 11. As described above, in the constant voltage digital time gradation, the OLED driving TFT operates as a switch. It operates in a linear region so that Vds of the TFT becomes smaller. At this time, an operating point as shown in FIG. 5B is obtained. As in the constant current analog gradation, when the luminous intensity is assumed to be 200 cd/$m^2$ and the same material is used, a voltage between the cathode and the source of the driving TFT can be reduced in the constant voltage time gradation. This is because Vds is small as described above so that the voltage between the cathode and the source of the driving TFT is substantially equal to a voltage between the cathode and the anode of the OLED.

Figure 11:
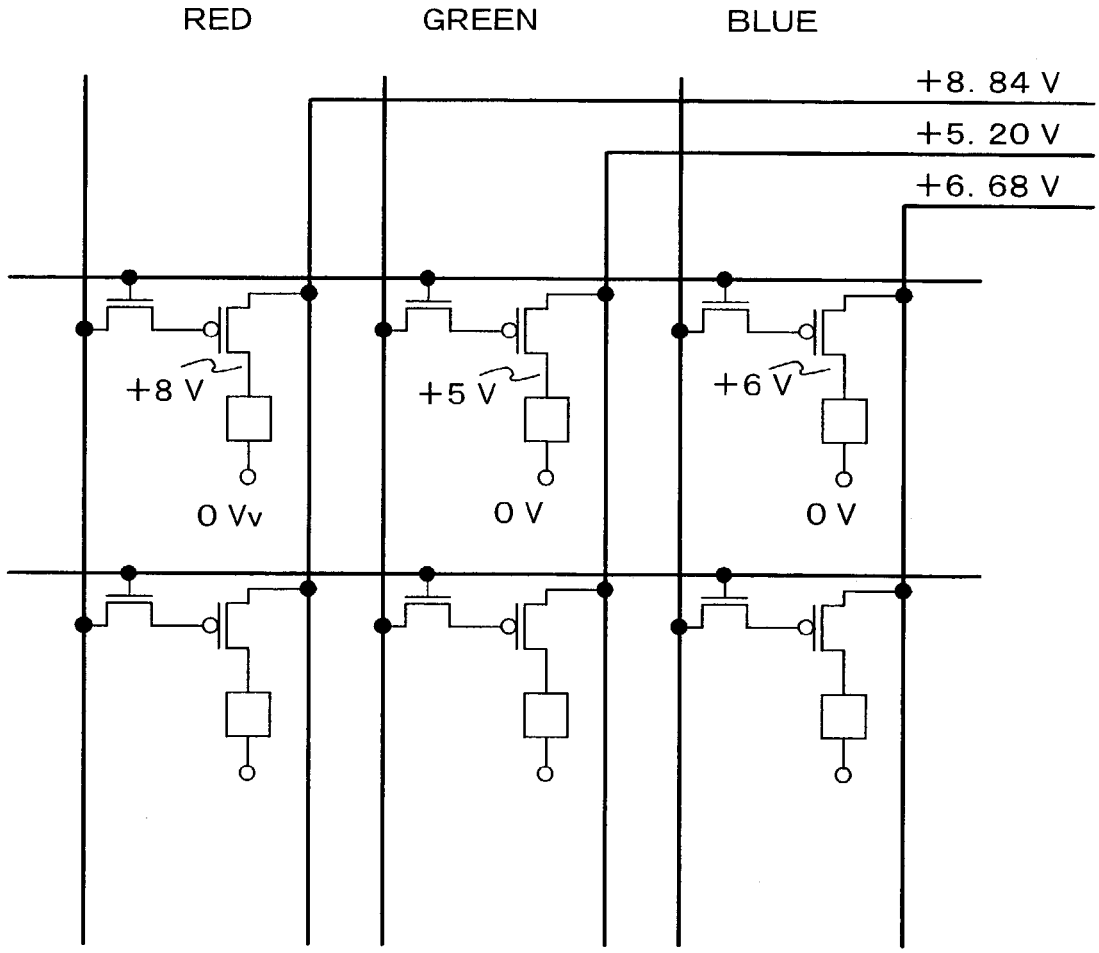
FIG. 11 shows a potential relationship of time gradation drive.
Figure 12A:
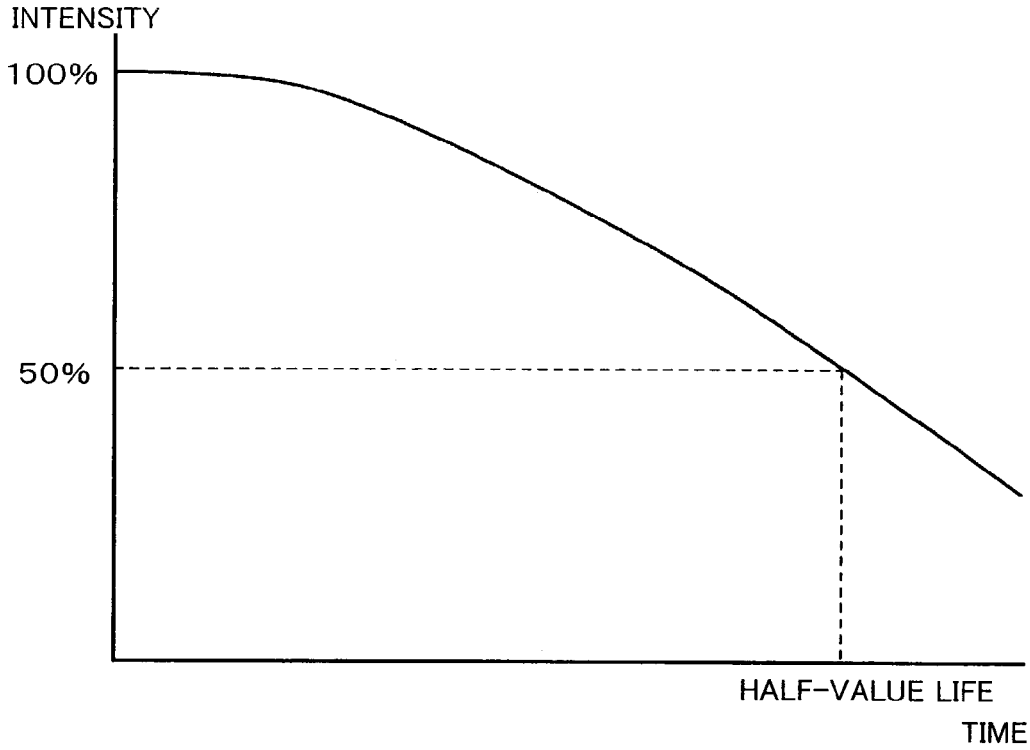
FIGS. 12A and 12B show deterioration characteristics of an OLED.
Figure 12B:
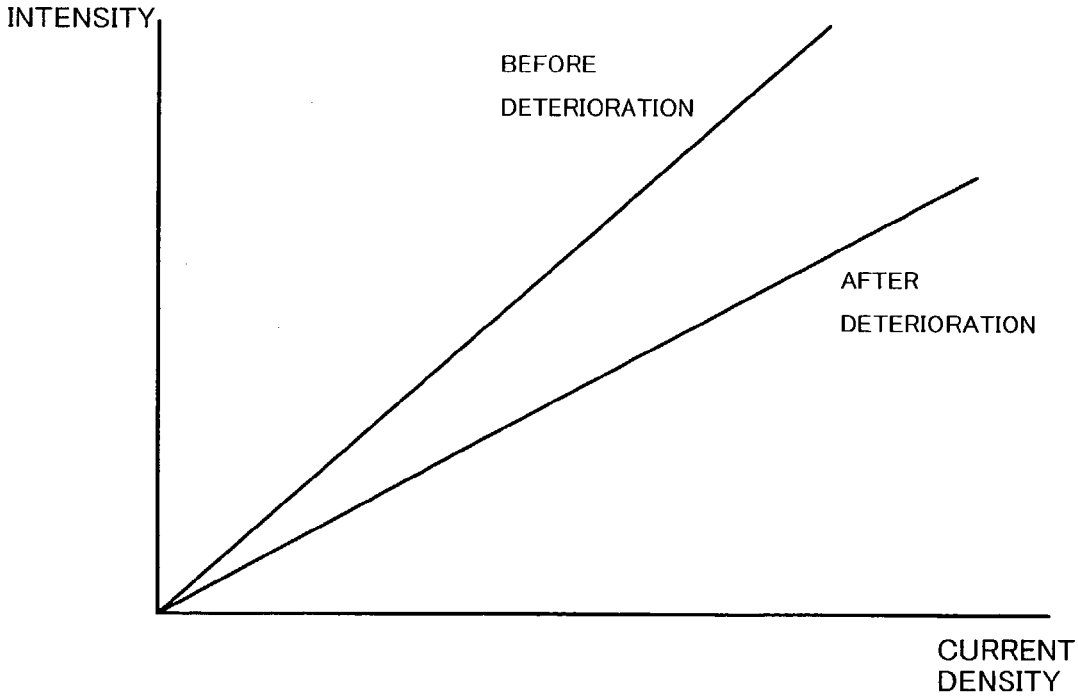
Figure 13A:
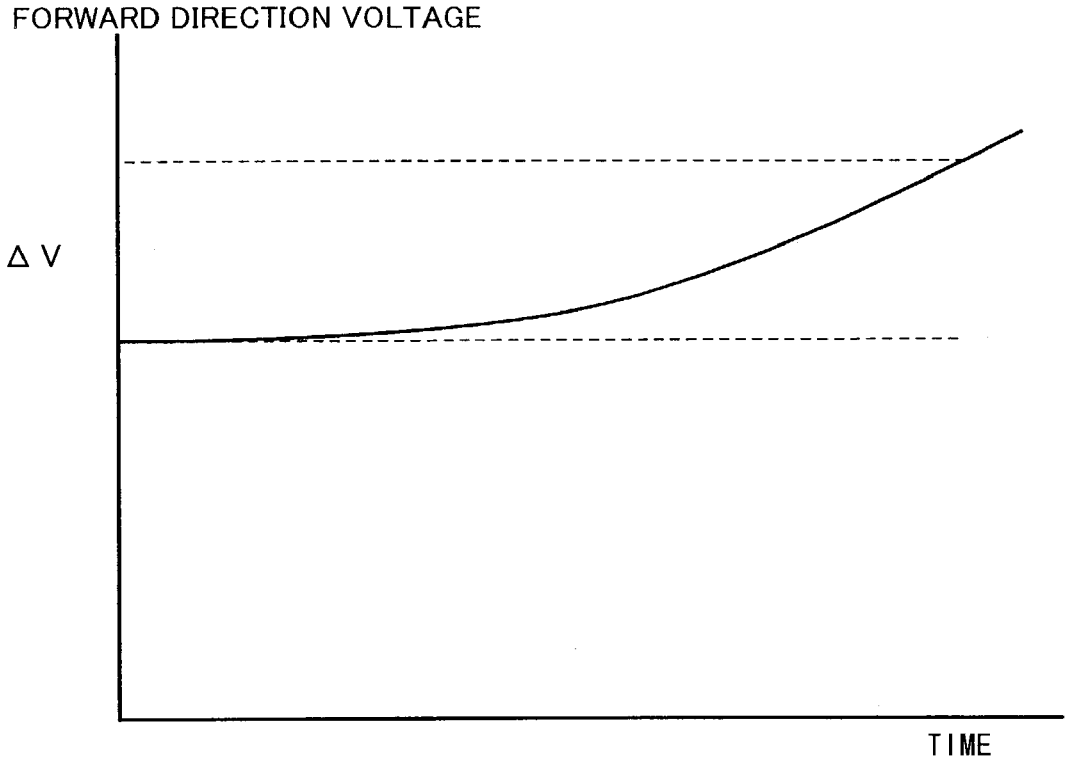
FIGS. 13A and 13B show deterioration characteristics of the OLED.
Figure 13B:
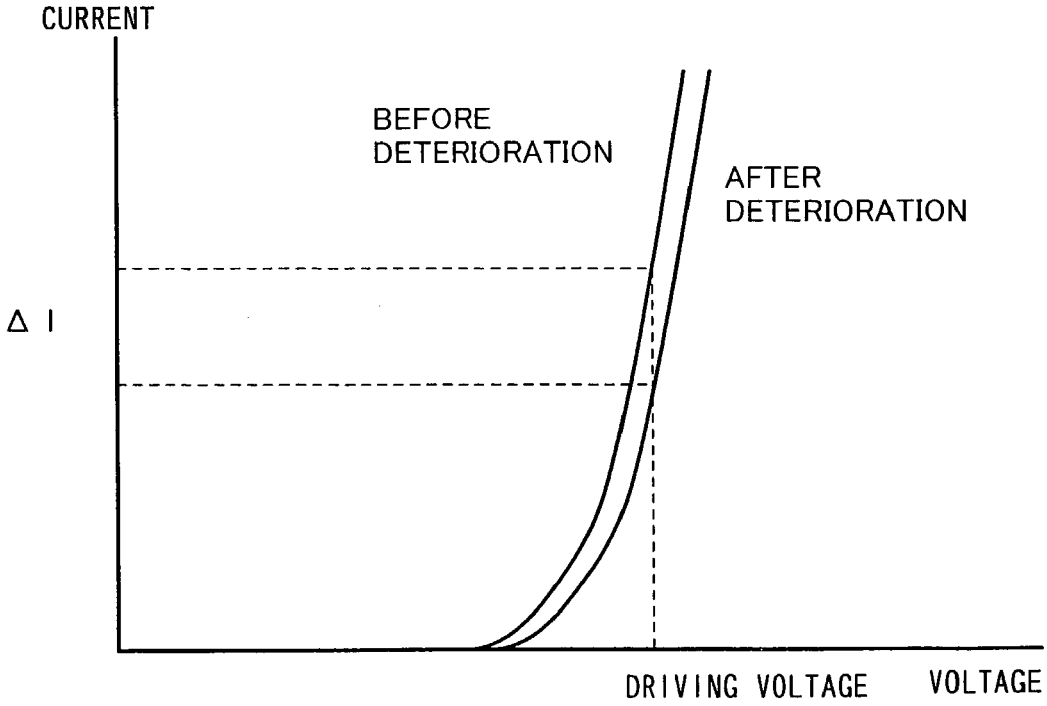

Hereinafter, a potential relationship will be described with reference to FIG. 11. When a cathode potential is assumed to be 0 V, anode potentials in red, green, and blue become +8 V, +5 V, and +6 V, respectively. Source potentials of the OLED driving TFTs also become close to these potentials. When Vds is calculated from a current equation in the linear region (equation 2), the source potentials become 0.84 V, 0.20 V, and 0.68 V, respectively. Forward direction voltages of the OLEDs are added to these source potentials so that the potentials between the cathode and the source of the driving TFT in red, green, and blue become +8.84 V, +5.20 V, and +6.68 V, respectively. Note that the gate potentials of the respective OLED driving TFTs at this time are set to −5 V. In other words, respective Vgs are −13.84 V, −10.2 V, and −11.68 V.

$$Id=\mu\cdot Co\cdot W/L\cdot(Vgs-Vth)\cdot Vds \quad (2)$$

Based on the above descriptions, when the constant voltage time gradation drive is conducted, the variable voltage source 135 outputs voltages of +8.84 V, +5.20 V, and +6.68 V to the respective power source lines 120, 121, and 122 for three colors of red, green, and blue. Those values are the same as those shown in FIG. 11. In addition, the variable voltage source 136 outputs 0 V to the cathode. This value is the same value as shown in FIG. 11. The variable voltage source 134 outputs −5 V to DC potential lines 107, 108, and 109 for turning on the OLED driving TFT and outputs +10 V to DC potential lines 110, 111, and 112 for turning off the OLED driving TFT. Here, a set of the DC potential lines 107, 108, and 109 and a set of the DC potential lines 110, 111, and 112 each are made common but may be separately set for power consumption reduction.

As described above, according to the present invention, the output voltages of the external variable voltage sources 134, 135, and 136 are changed and the operation of the analog switches 123 to 131 is controlled. Thus, switching between both the constant current analog gradation drive and the constant voltage time gradation drive can be conducted for driving so that either of drives can be suitably selected according to display contents.

Note that the present invention can be applied not only to a display device using the OLED but also to a display device using another light emitting element.

Hereinafter, embodiments of the present invention will be described.

[Embodiment 1]

Figure 14:
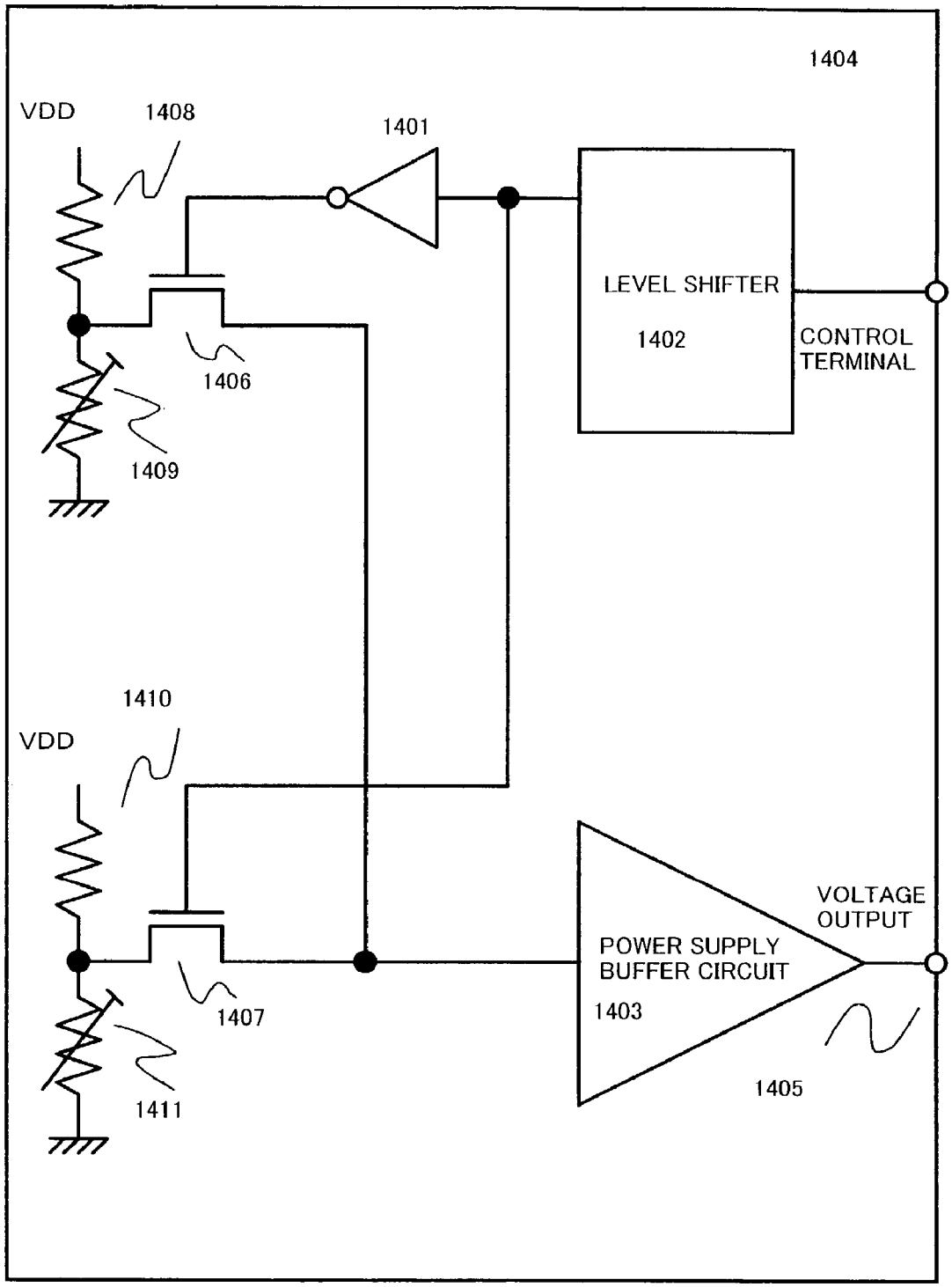
FIG. 14 shows an embodiment of the present invention.

FIG. 14 shows an embodiment of a variable voltage source used in the present invention. In the variable voltage source shown in FIG. 14, a first reference voltage is produced by a fixed resistor 1408 and a variable resistor 1409 and a second reference voltage is produced by a fixed resistor 1410 and a variable resistor 1411. The reference voltage values can be changed by changing values of the variable resistors 1409 and 1411.

Any one of the two reference voltages is selected by using FET switches 1406 and 1407 and inputted to a power source buffer circuit 1403. The output of the power source buffer circuit 1403 is connected with a display device through an output terminal 1405.

Here, the fixed resistor and the variable resistor are combined with each other to set the reference voltage. However, setting of the reference voltage is not limited to this method. In addition, although not shown here, a power source buffer circuit composed of an operational amplifier, an emitter follower, or a source follower may be used.

Figure 15:
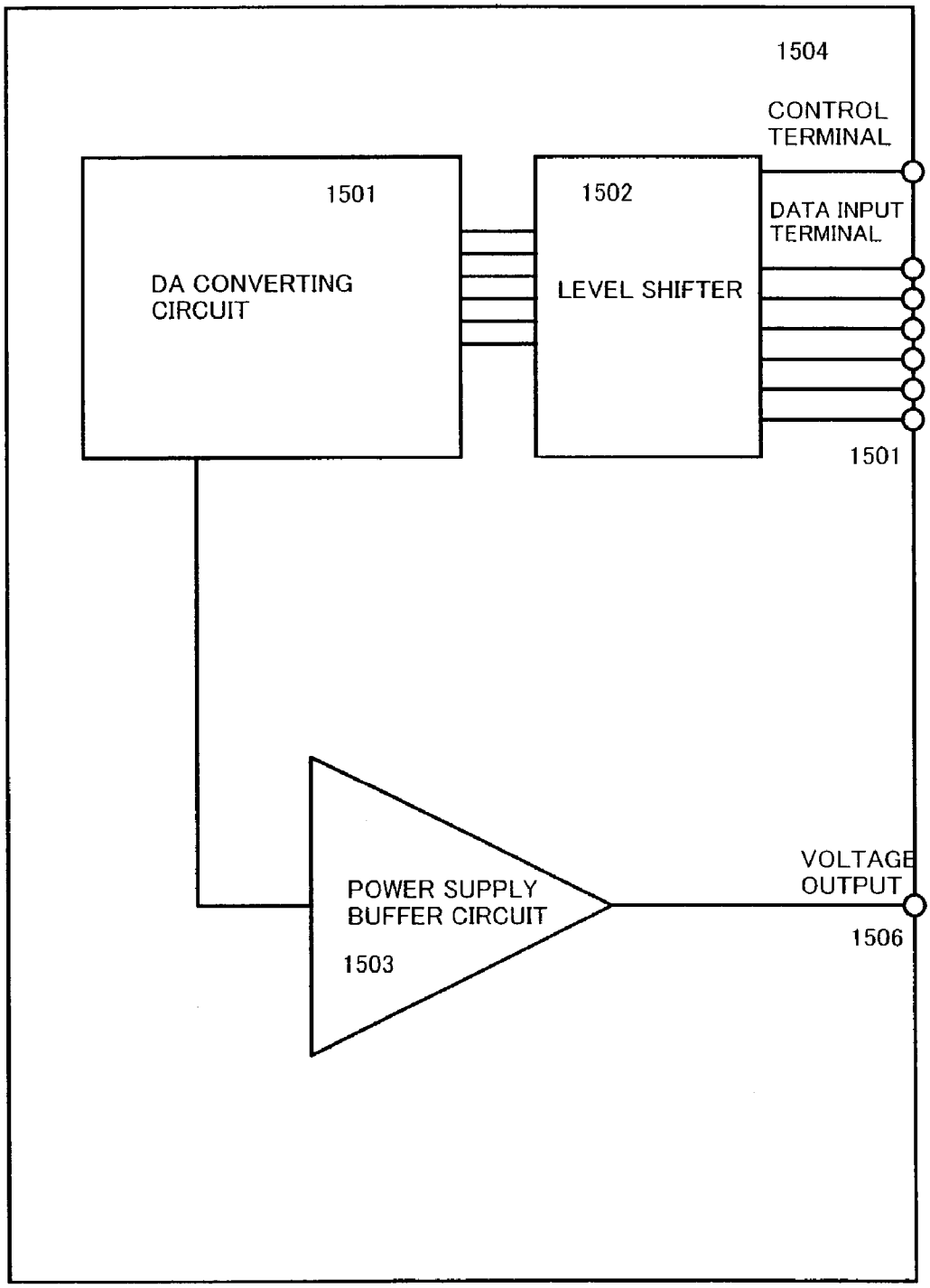
FIG. 15 shows another embodiment of the present invention.

FIG. 15 shows an example in which a DA converting circuit 1501 is used as a variable voltage source of a reference voltage source. The reference voltage to be set is controlled according to a data signal from a control circuit. The data is stored in an inner portion of the control circuit or in an externally provided nonvolatile memory circuit and outputted as occasion demands.

The necessary amount of data in the memory is prepared for each drive method. When a drive method is selected, corresponding data is transferred to the DA converting circuit so that a voltage required for the drive method can be obtained. The output of the DA converting circuit 1501 is outputted to the output terminal through a power source buffer circuit 1503 as in the embodiment shown in FIG. 14.

[Embodiment 2]

Figure 17:
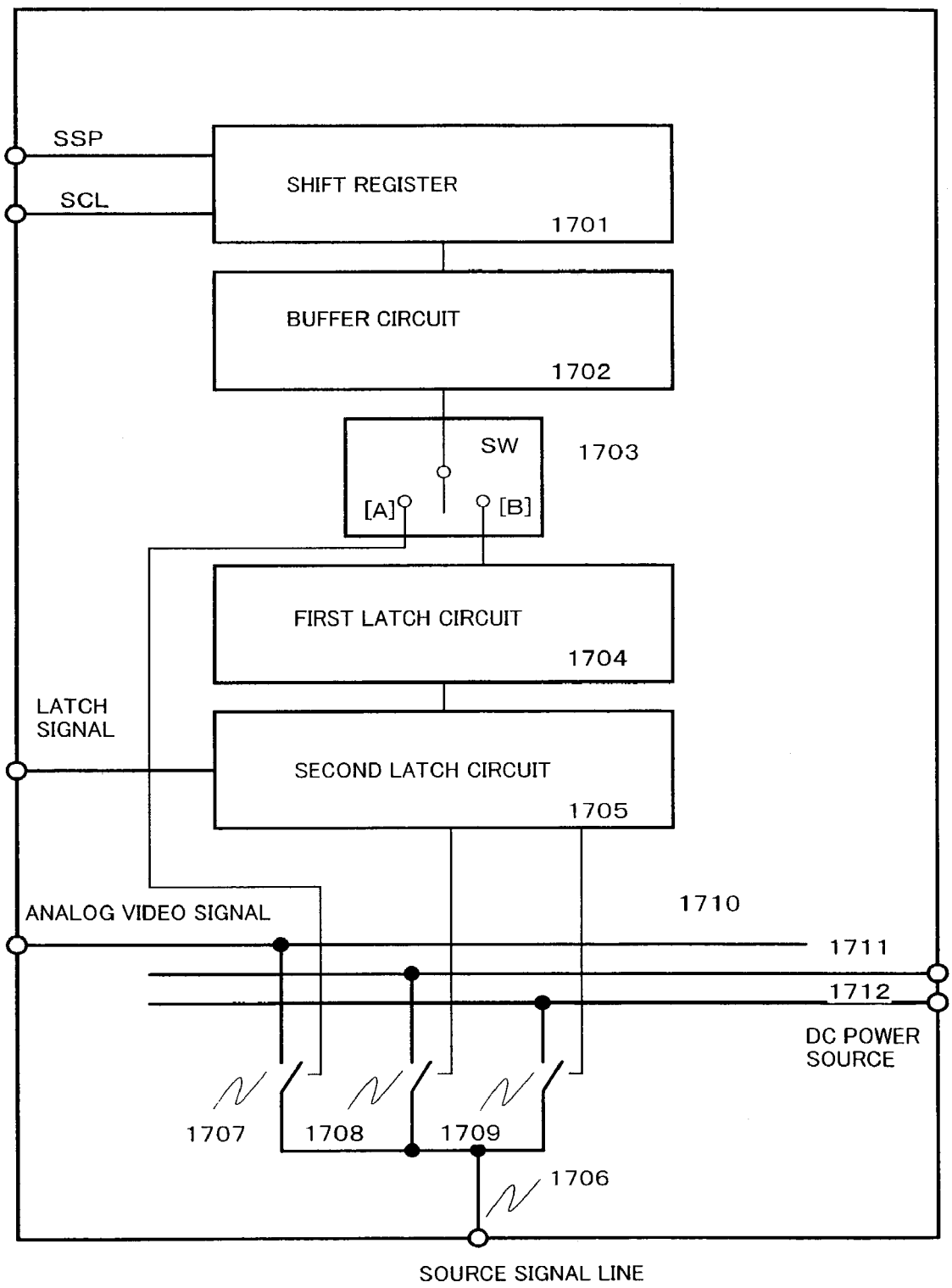
FIG. 17 shows an embodiment of a source signal line driver circuit of the present invention.

FIG. 17 shows an embodiment of source signal line drive of the present invention. First, the constant current analog gradation drive will be described. A start pulse SSP and a clock pulse SCL are inputted to a shift register 1701 and then a pulse is shifted in order. The pulse is inputted to a switch 1703 through a buffer circuit 1702. In the constant current analog gradation, latch circuits 1704 and 1705 are not used. Thus, a switching terminal of the switch 1703 is connected with an [A] side to control an analog switch 1707 for connecting an analog video signal line 1710 and a source signal line 1706. Therefore, the analog video signals are sampled in succession and supplied to the source signal line 1706.

Next, the constant voltage time gradation drive will be described. As in the above drive, the start pulse SSP and the clock pulse SCL are inputted to the shift register 1701. However, a subframe is used so that the frequency is not necessarily the same and generally becomes higher. In response to the start pulse SSP and the clock pulse SCL, the pulse is shifted in order and transferred to the switch 1703 through the buffer circuit 1702. In the constant voltage time gradation, the switching terminal is connected with the [B] side so that the pulse is transferred to the first latch circuit 1704. Data in the first latch circuit is transferred to the second latch circuit 1705 during a retrace period. According to the output of the second latch circuit 1705, any one of analog switches 1708 and 1709 is selected and either potential of power source lines 1711 and 1712 is transferred to a source signal line 1706.

Thus, the source signal line driver circuit selectively conducts any one of the constant current analog gradation drive and the constant voltage time gradation drive.

[Embodiment 3]

Figure 16:
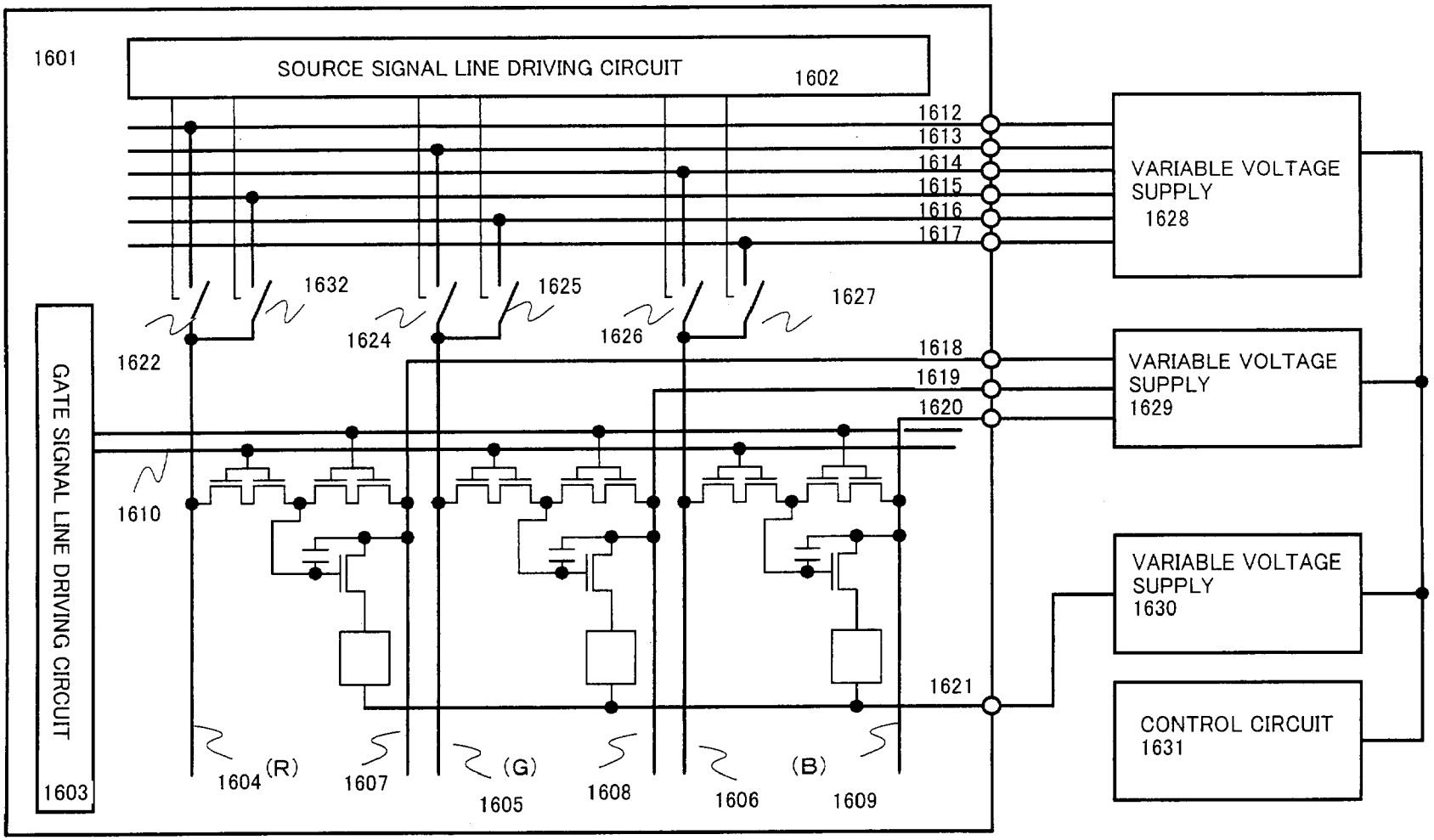
FIG. 16 shows a configuration of a display device of the present invention.

FIG. 16 shows an embodiment of a method of switching between a constant current time gradation method and a constant voltage time gradation method as a drive method. The two methods each are a time gradation method. Thus, an analog video signal is unnecessary and a source signal line driver circuit 1602 may have the same common structure. Only a drive potential in operation is different so that a linear region and a saturation region of an OLED driving TFT are separately used.

Setting potentials at this time in the respective drive methods are as follows.

First, in the constant current time gradation drive, a potential on a DC power source line 1621 corresponding to a cathode potential is set to −8 V, a potential on each of DC power source lines 1618, 1619, and 1620 corresponding to a source potential of the OLED driving TFT is set to +9 V, potentials on DC potential lines 1612, 1613, and 1614 for turning on the OLED driving TFT are set to +2.53 V, +5.17 V, and +3.35 V, respectively, and a potential on each of DC potential lines 1615, 1616, and 1617 for turning off the OLED driving TFT is set to +10 V. Those values are the same as those shown in FIG. 11.

In the constant voltage time gradation drive, a potential on a DC power source line 1621 corresponding to the cathode potential is set to 0 V, potentials on the DC power source lines 1618, 1619, and 1620 corresponding to the source potential of the OLED driving TFT are set to +8.84 V, +5.21 V, and +6.68 V, respectively, a potential on each of the DC potential lines 1612, 1613, and 1614 for turning on the OLED driving TFT is set to −5 V, and a potential on each of the DC potential lines 1615, 1616, and 1617 for turning off the OLED driving TFT is set to +9 V. Those values are the same as those shown in FIG. 11.

Also, according to this embodiment, two switching TFTs are used for a pixel. Thus, there is provided a function for not only conducting selection with respect to the source signal line but also for short-circuiting between the gate of the driving TFT and the power supply line. Accordingly, improvement of light emission duty can be expected. Note that this drive method is described in JP 2001-343933 A.

Note that the present invention can be applied not only to a display device using the OLED but also to a display device using another light emitting element.

[Embodiment 4]

Figure 18B:
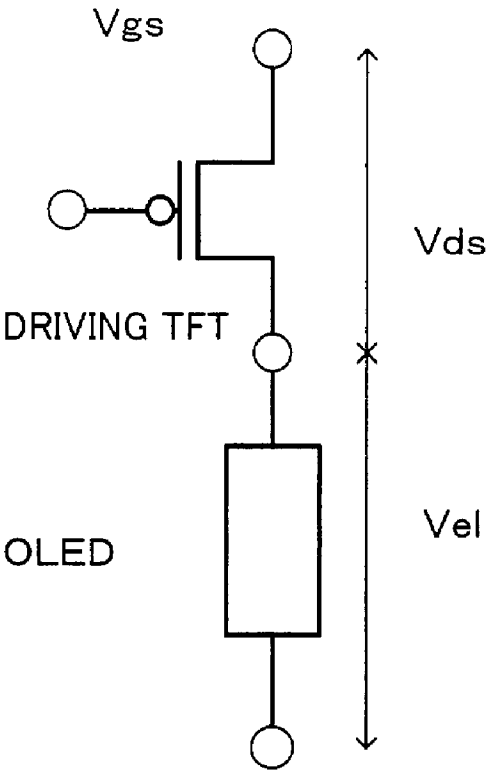
FIGS. 18A and 18B show an operating point in the case where a middle voltage is used.
Figure 18A:
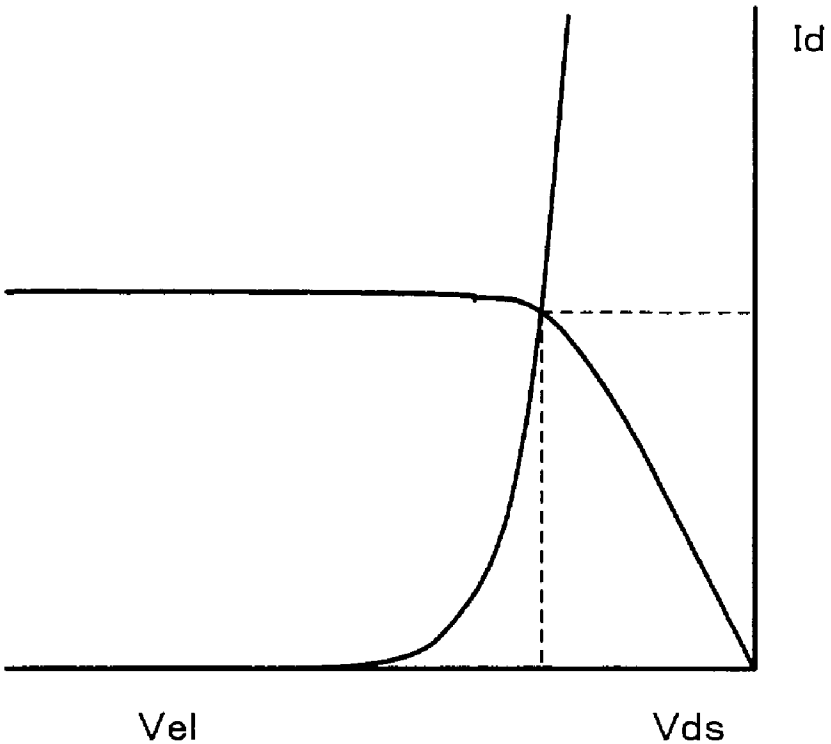

FIGS. 18A and 18B show an example in the case where a middle region except a linear region and a saturation region is used as a drive region of a TFT and the TFT is driven. In this case, drive in which an OLED and a power supply line are connected with each other through a relatively large resistor is conducted. With respect to the influences on display nonuniformity and deterioration of an OLED as well, there are obtained characteristics that are halfway between those of the constant current drive and those of constant voltage drive.

Figure 19:
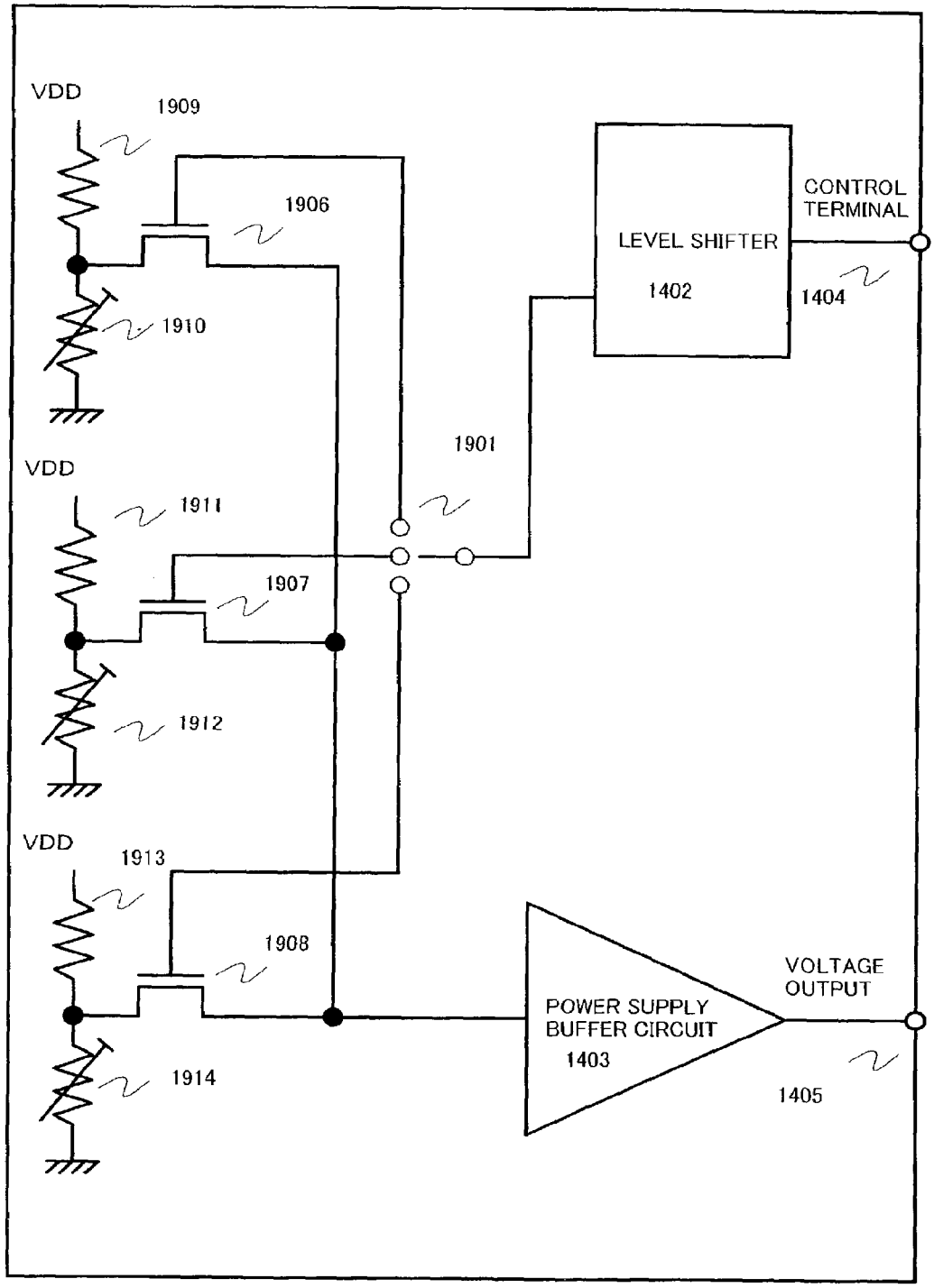
FIG. 19 shows an embodiment in which switching among three voltage values is conducted.

Also, in actual drive, switching among three regions, that is, the linear region, the above middle region, and the saturation region can be conducted. In such a case, it is necessary to output three values in a variable voltage source. This can be achieved by using a variable voltage source circuit as shown in FIG. 19.

In addition, in a variable voltage circuit using the DA converting circuit shown in FIG. 15, when the number of data in a nonvolatile memory is increased, three kinds of voltages can be outputted.

Note that the present invention can be applied not only to a display device using the OLED but also to a display device using another light emitting element.

[Embodiment 5]

Figure 20:
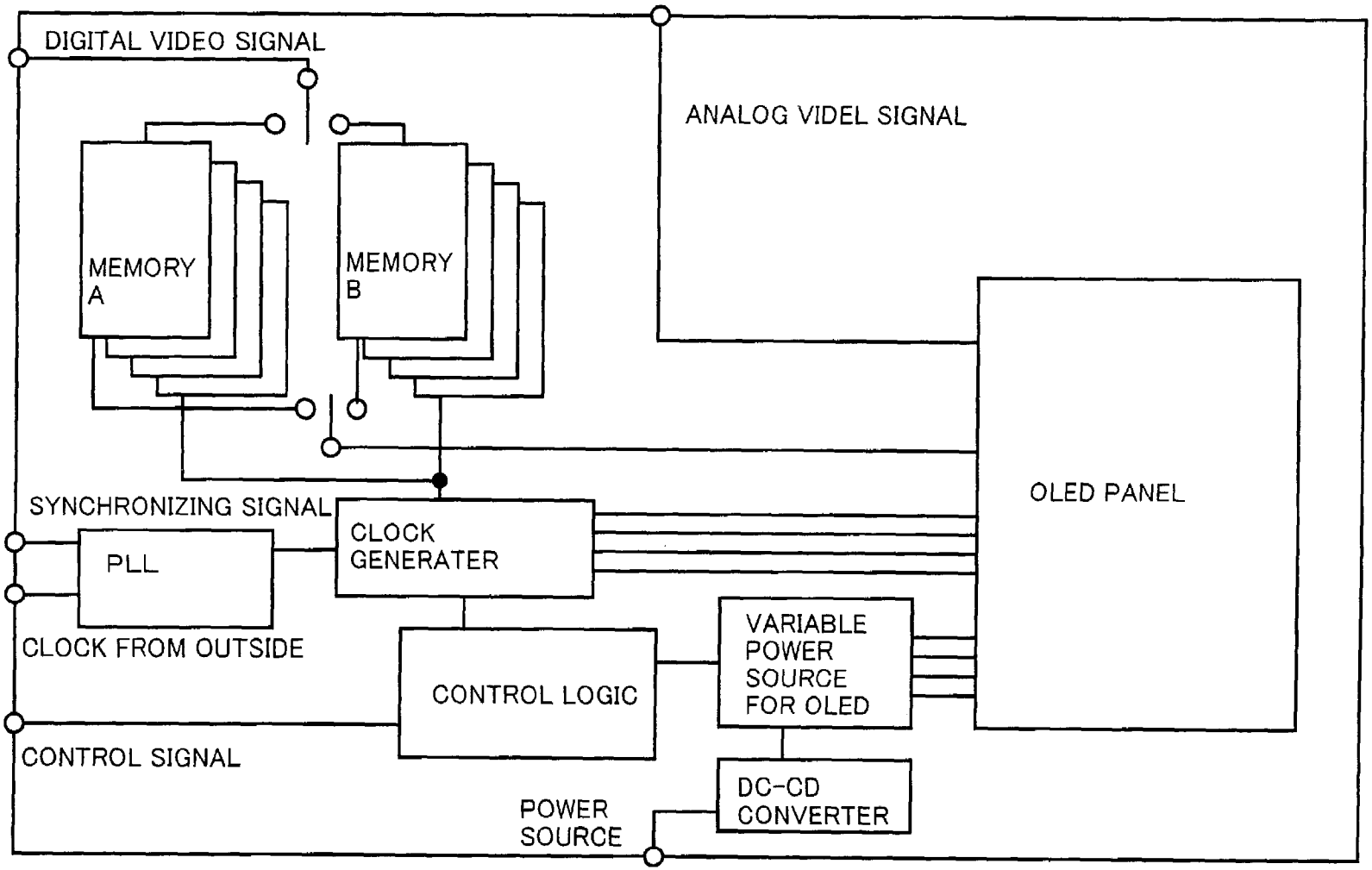
FIG. 20 shows an embodiment of a module in which an OLED is mounted.

Embodiment 5 is shown in FIG. 20. FIG. 20 shows an embodiment of an OLED module using the present invention. In the OLED module of the embodiment shown in FIG. 20, in addition to the OLED display device and the variable voltage sources for OLED which are described above, the followings are incorporated. That is, a DC-DC converting circuit, a control logic, a clock generator, frame memories, and the like are incorporated. In general, the battery voltage of a mobile information device is about 3 V to about 5 V. On the other hand, when an OLED is to be driven, a voltage higher than that is required. Thus, a necessary voltage is generated by raising the battery voltage using the DC—DC converting circuit.

Also, the control logic generates signals required for performing switching between the constant current analog gradation and the constant voltage time gradation and supplies the signals to respective blocks. The clock generator is a circuit necessary to generate signals such as a start pulse, a clock pulse, a latch pulse, and the like which is required for a display device from a synchronizing signal and a reference clock signal which are inputted from the outside. The clock generator, the control logic, and the like can be also incorporated in an OLED panel.

The frame memory is used for storing digital video signals and generating subframe data. With respect to the subframe data, it is required that data corresponding to one frame is first stored for each bit and next read out in order for each bit. First, digital video data of a first frame is stored in a memory A. Next, while digital video data of a second frame is stored in a memory B, the data in the memory A is read out in a changed order to the OLED panel. Next, while digital video data of a third frame is stored in the memory A, the data in the memory B is read out in a changed order to the OLED panel. Such operation is repeated to conduct time gradation display.

When analog gradation display is conducted, analog video signals are inputted to perform display.

Thus, according to this embodiment, two kinds of displays, that is, the analog gradation display and the time gradation display can be conducted.

Note that the present invention can be applied not only to a display device using the OLED but also to a display device using another light emitting element.

[Embodiment 6]

Figure 21:
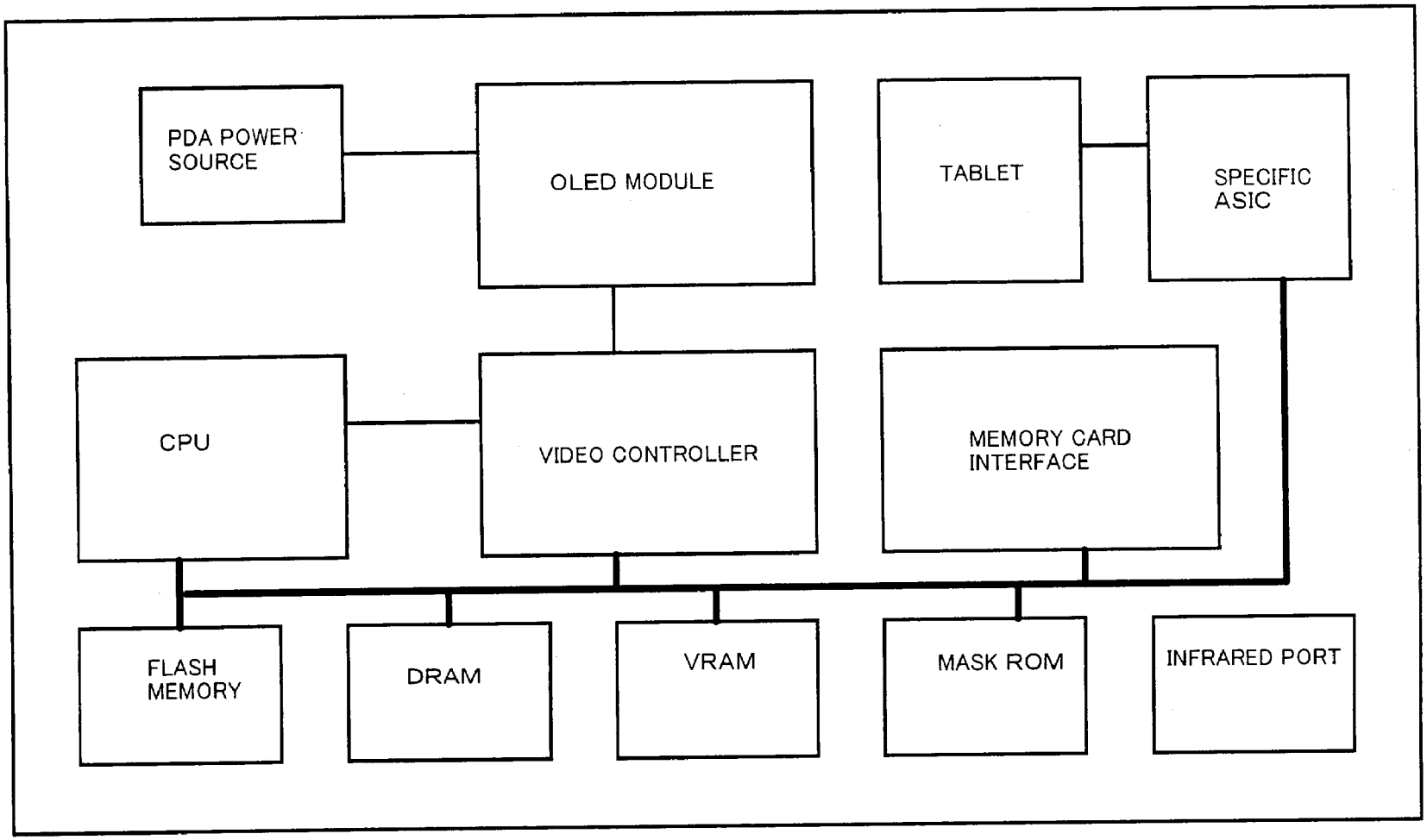
FIG. 21 shows an embodiment of a PDA in which an OLED module is mounted.

FIG. 21 shows an embodiment of a PDA (personal digital assistant) using a display device of the present invention. The PDA of this embodiment is composed of an OLED module, a power source, a CPU, a video controller, various memories such as a DRAM, VRAM, a mask ROM, a memory card interface, a specific ASIC, a tablet, an infrared port, and the like. Various video data can be displayed on an OLED display device.

The PDA using the present invention is not limited to this embodiment. Other functions including, for example, a telephone function may also be added. Hence, its applications are unlimited.

Note that the present invention can be applied not only to a display device using the OLED but also to a display device using another light emitting element.

[Embodiment 7]

Display devices using light emitting elements such as an OLED are self-luminous, and therefore are superior in visibility in bright places and have a wider angle of view compared with a liquid crystal display. Accordingly, a light emitting device of the present invention can be used in display portions of various electronic equipment.

Examples of electronic equipment using the light emitting devices of the present invention include video cameras, digital cameras, goggle type displays (head mounted displays), navigation systems, audio playback devices (car audios, audio components, etc.), notebook type personal computers, game machines, portable information terminals (mobile computers, mobile telephones, mobile type game machines, and electronic books, etc.), image reproduction devices equipped with a recording medium (specifically, devices equipped with a display capable of reproducing the recording medium such as a digital versatile disk (DVD), etc. and displaying the image thereof), and the like. In particular, as for portable information terminals whose screen is often viewed from a diagonal direction, since a wide angle of view is regarded as important, the light emitting device is desirably used. Specific examples of these electronic equipment are shown in FIG. 22.

Figure 22A:
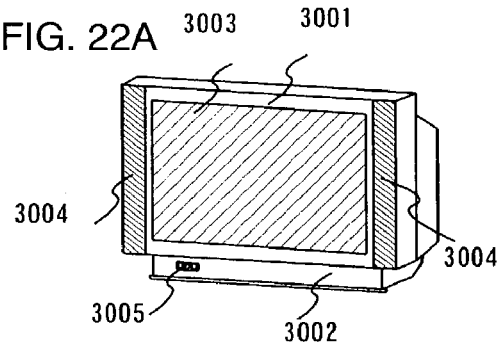
FIGS. 22A to 22H show examples of electronic equipment to which the present invention can be applied.

FIG. 22A is a display device, which is composed of a frame 3001, a support base 3002, a display portion 3003, a speaker portion 3004, a video input terminal 3005, and the like. The present invention can be used in the display portion 3003. As the light emitting device is a self-luminous type, there is no need for a backlight, thereby it is possible to obtain a thinner display portion than that of a liquid crystal display device. Note that the term display device includes all display devices for displaying information, such as for personal computers, for receiving TV broadcasting, and for advertising.

Figure 22B:
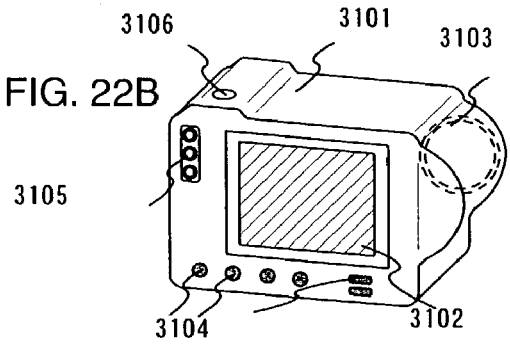

FIG. 22B is a digital still camera, which is composed of a main body 3101, a display portion 3102, an image-receiving portion 3103, operation keys 3104, an external connection port 3105, a shutter 3106, and the like. The present invention can be used in the display portion 3102.

Figure 22C:
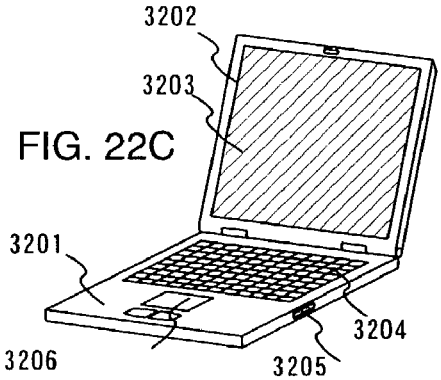

FIG. 22C is a notebook type personal computer, which is composed of a main body 3201, a frame 3202, a display portion 3203, a keyboard 3204, an external connection port 3205, a pointing mouse 3206, and the like. The present invention can be used in the display portion 3203.

Figure 22D:
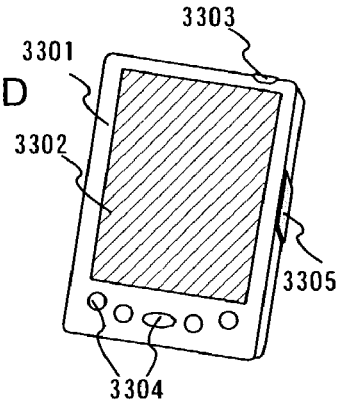

FIG. 22D is a mobile computer, which is composed of a main body 3301, a display portion 3302, a switch 3303, operation keys 3304, an infrared port 3305, and the like. The present invention can be used in the display portion 3302.

Figure 22E:
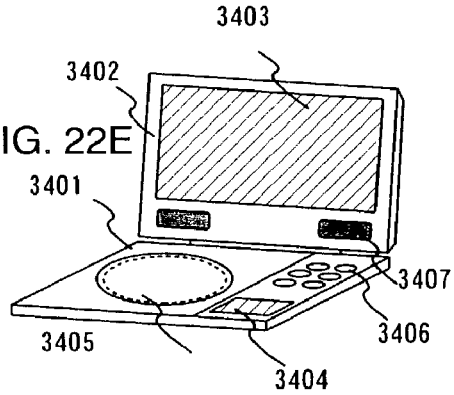

FIG. 22E is a portable image reproduction device provided with a recording medium (specifically, a DVD playback device), which is composed of a main body 3401, a frame 3402, a display portion A 3403, a display portion B 3404, a recording medium (such as a DVD) read-in portion 3405, operation keys 3406, a speaker portion 3407, and the like. The display portion A 3403 mainly displays image information, and the display portion B 3404 mainly displays character information, and the present invention can be used in the display portion A 3403 and in the display portion B 3404. Note that image reproduction devices provided with a recording medium include game machines for domestic use and the like.

Figure 22F:
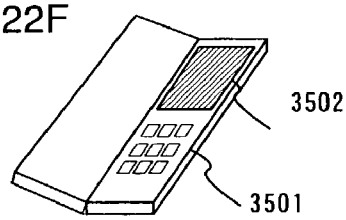

FIG. 22F is a folding portable information device which is composed of a main body 3501, a display portion 3502, and the like. The present invention can be used in the display portion 3502.

Figure 22G:
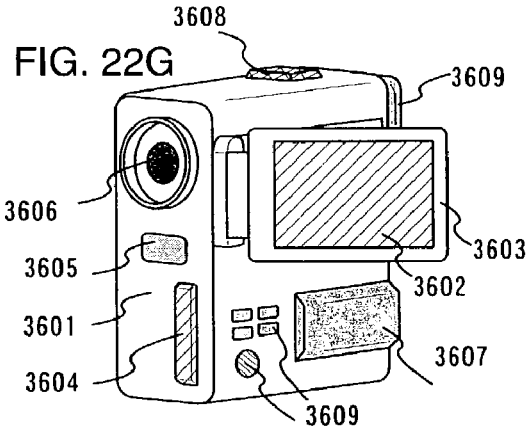

FIG. 22G is a video camera, which is composed of a main body 3601, a display portion 3602, a frame 3603, an external connection port 3604, a remote control receiving portion 3605, an image receiving portion 3606, a battery 3607, an audio input portion 3608, operation keys 3609, an eyepiece portion 3610, and the like. The light emitting device of the present invention can be used in the display portion 3602.

Figure 22H:
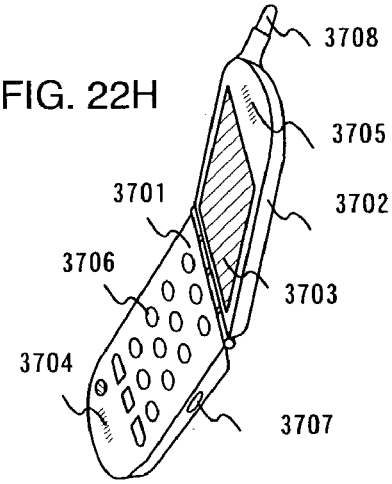

FIG. 22H is a mobile telephone, which is composed of a main body 3701, a frame 3702, a display portion 3703, an audio input portion 3704, an audio output portion 3705, operation keys 3706, an external connection port 3707, an antenna 3708, and the like. The present invention can be used in the display portion 3703. Note that by displaying white characters on a black background, the display portion 3703 can suppress the power consumption of the mobile telephone. Note that if the light emitting intensity of the organic light emitting materials increases in the future, the light including the outputted image information can be enlarged and projected with a lens or the like, whereby it is possible to use the projected light in front type projectors or rear type projectors.

Electronic equipment such as those described above now increasingly display information distributed through electronic communication lines such as the Internet and CATV (cable television), particularly animated information. Since organic light emitting materials have very high response speed, light emitting devices are preferably used for animated display.

In a light emitting device, areas that emit light consume power and therefore information is preferably displayed in such a manner as to reduce areas that emit light as much as possible. It is therefore preferable to drive the light emitting device so that areas that do not emit light are used for the background and areas that do not emit light are used for text information when the light emitting device is used in a display unit of portable information terminals, particularly mobile phones and audio playback devices in which mainly text information is displayed.

Note that it is possible to apply the present invention to display devices using a light emitting element other than an OLED.

As described above, the application scope of the light emitting device manufactured in accordance with a manufacturing method of the present invention is so wide that the light emitting device of the present invention can be used in electronic equipment of any field. The electronic equipment of this embodiment can be obtained by using light emitting devices that are manufactured in accordance with any one of Embodiments 1 through 6.

As described hereinabove, according to the present invention, switching between the constant current drive and the constant voltage drive is conducted as appropriate in driving the OLED. Thus, it is possible to achieve a drive in which respective advantages of both the drives are utilized. Note that the present invention can be applied not only to a display device using the OLED but also to a display device using another light emitting element.

What is claimed is:

1. A display device comprising:

a plurality of pixels arranged in matrix on a substrate, each of the pixels having an OLED, at least one switching transistor, and at least one OLED driving transistor;

a plurality of source signal lines and a plurality of gate signal lines on the substrate; and at least one circuit for switching between a first drive mode for driving the OLED driving transistor in a saturation region and a second drive mode for driving the OLED driving transistor in a linear region.

2. A device according claim 1, wherein the first drive mode is analog current drive.

3. A device according claim 1, wherein the first drive mode is digital time gradation.

4. A device according claim 1, wherein the second drive mode is digital time gradation.

5. A device according claim 1, wherein a potential change for drive mode switching is controlled by an external circuit.

6. A device according to claim 1, wherein a potential change for drive mode switching is controlled by an external DA converting circuit.

7. A display module using a display device according to claim 1.

8. An electronic equipment using a display device according to claim 1.

9. A display device comprising:

a plurality of pixels arranged in matrix on a substrate, each of the pixels having an OLED, at least one switching transistor, and at least one OLED driving transistor;

a plurality of source signal lines and a plurality of gate signal lines on the substrate;

at least one circuit for switching among a first drive mode for driving the OLED driving transistor in a saturation region, a second drive mode for driving the OLED driving transistor in a linear region, and a third drive mode for driving the OLED driving transistor in a middle region between the linear region and the saturation region.

10. A device according claim 9, wherein the first drive mode is analog current drive.

11. A device according claim 9, wherein the first drive mode is digital time gradation.

12. A device according claim 9, wherein the second drive mode is digital time gradation.

13. A device according claim 9, wherein a potential change for drive mode switching is controlled by an external circuit.

14. A device according to claim 9, wherein a potential change for drive mode switching is controlled by an external DA converting circuit.

15. A display module using a display device according to claim 9.

16. An electronic equipment using a display device according to claim 9.

17. A method of driving a display device in which a plurality of pixels, a plurality of source signal lines, and a plurality of gate signal lines are arranged in matrix on a substrate, each of the pixels having an OLED, at least one switching transistor, and at least one OLED driving transistor, the method comprising:

driving the display device by switching between a first drive mode for driving the OLED driving transistor in a saturation region and a second drive mode for driving the OLED driving transistor in a linear region.

18. A method according to claim 17, wherein the first drive mode is a mode using analog current drive.

19. A method according to claim 17, wherein the first drive mode is a mode using digital time gradation.

20. A method according to claim 17, wherein the second drive mode is a mode using digital time gradation.

21. A display module using a method of driving a display device according to claim 17.

22. An electronic equipment using a method of driving a display device according to claim 17.

23. A method of driving a display device in which a plurality of pixels, a plurality of source signal lines, and a plurality of gate signal lines are arranged in matrix on a substrate, each of the pixels having an OLED, at least one switching transistor, and at least one OLED driving transistor, the method comprising:

driving the display device by switching among a first drive mode for driving the OLED driving transistor in a saturation region, a second drive mode for driving the OLED driving transistor in a linear region, and a third drive mode for driving the OLED driving transistor in a middle region between the linear region and the saturation region.

24. A method according to claim 23, wherein the first drive mode is a mode using analog current drive.

25. A method according to claim 23, wherein the first drive mode is a mode using digital time gradation.

26. A method according to claim 23, wherein the second drive mode is a mode using digital time gradation.

27. A display module using a method of driving a display device according to claim 23.

28. An electronic equipment using a method of driving a display device according to claim 23.

29. A display device comprising:

a plurality of pixels arranged in matrix on a substrate, each of the pixels having a light emitting element, at least one switching transistor, and at least one light emitting element driving transistor;

a plurality of source signal lines and a plurality of gate signal lines on the substrate;

at least one circuit for switching between a first drive mode for driving the light emitting element driving transistor in a saturation region and a second drive mode for driving the light emitting element driving transistor in a linear region.

30. A device according claim 29, wherein the first drive mode is analog current drive.

31. A device according claim 29, wherein the first drive mode is digital time gradation.

32. A device according claim 29, wherein the second drive mode is digital time gradation.

33. A device according claim 29, wherein a potential change for drive mode switching is controlled by an external circuit.

34. A device according claim 29, wherein a potential change for drive mode switching is controlled by an external DA converting circuit.

35. A display module using a display device according to claim 29.

36. An electronic equipment using a display device according to claim 29.

37. A display device comprising:

a plurality of pixels arranged in matrix on a substrate, each of the pixels having a light emitting element, at least one switching transistor, and at least one light emitting element driving transistor;

a plurality of source signal lines and a plurality of gate signal lines on the substrate;

at least one circuit for switching among a first drive mode for driving the light emitting element driving transistor in a saturation region, a second drive mode for driving the light emitting element driving transistor in a linear region, and a third drive mode for driving the light emitting element driving transistor in a middle region between the linear region and the saturation region.

38. A device according claim 37, wherein the first drive mode is analog current drive.

39. A device according claim 37, wherein the first drive mode is digital time gradation.

40. A device according claim 37, wherein the second drive mode is digital time gradation.

41. A device according claim 37, wherein a potential change for drive mode switching is controlled by an external circuit.

42. A device according claim 37, wherein a potential change for drive mode switching is controlled by an external DA converting circuit.

43. A display module using a display device according to claim 37.

44. An electronic equipment using a display device according to claim 37.

45. A method of driving a display device in which a plurality of pixels, a plurality of source signal lines, and a plurality of gate signal lines are arranged in matrix on a substrate, each of the pixels having a light emitting element, the method comprising:

driving the display device by switching between a first drive mode for driving the light emitting element at a constant current and a second drive mode for driving the light emitting element at a constant voltage.

46. A method of driving a display device in which a plurality of pixels, a plurality of source signal lines, and a plurality of gate signal lines are arranged in matrix on a substrate, each of the pixels having a light emitting element, at least one switching transistor, and at least one light emitting element driving transistor, the method comprising:

driving the display device by switching between a first drive mode for driving the light emitting element driving transistor in a saturation region and a second drive mode for driving the light emitting element driving transistor in a linear region.

47. A method according to claim 46, wherein the first drive mode is a mode using analog current drive.

48. A method according to claim 46, wherein the first drive mode is a mode using digital time gradation.

49. A method according to claim 46, wherein the second drive mode is a mode using digital time gradation.

50. A display module using a method of driving a display device according to claim 46.

51. An electronic equipment using a method of driving a display device according to claim 46.

52. A method of driving a display device in which a plurality of pixels, a plurality of source signal lines, and a plurality of gate signal lines are arranged in matrix on a substrate, each of the pixels having an light emitting element, at least one switching transistor, and at least one light emitting element driving transistor, the method comprising:

driving the display device by switching among a first drive mode for driving the light emitting element driving transistor in a saturation region, a second drive mode for driving the light emitting element driving transistor in a linear region, and a third drive mode for driving the light emitting element driving transistor in a middle region between the linear region and the saturation region.

53. A method according to claim 52, wherein the first drive mode is a mode using analog current drive.

54. A method according to claim 52, wherein the first drive mode is a mode using digital time gradation.

55. A method according to claim 52, wherein the second drive mode is a mode using digital time gradation.

56. A display module using a method of driving a display device according to claim 52.

57. An electronic equipment using a method of driving a display device according to claim 52.

58. A display device comprising:

a plurality of pixels arranged in matrix over a substrate, each of the pixels having a light emitting element comprising at least one transistor;

a plurality of source signal lines and a plurality of gate signal lines over the substrate;

at least one circuit for switching between a first drive mode and a second drive mode for driving the light emitting element according to display contents, wherein when character information is to be displayed, the first drive mode is used and when a natural picture is to be displayed, the second drive mode is used.

59. A device according claim 58, wherein the first drive mode is driving the light emitting element at a constant current.

60. A device according claim 58, wherein the first drive mode is driving the transistor of the light emitting element in a saturation region.

61. A device according claim 58, wherein the first drive mode is analog current drive.

62. A device according claim 58, wherein the first drive mode is digital time gradation.

63. A device according claim 58, wherein the second drive mode is driving the light emitting element at a constant voltage.

64. A device according claim 58, wherein the second drive mode is driving the transistor of the light emitting element in a linear region.

65. A device according claim 58, wherein the second drive mode is digital time gradation.

66. A device, according claim 58, wherein a potential change for drive mode switching is controlled by an external circuit.

67. A device according claim 58, wherein a potential change for drive mode switching is controlled by an external DA converting circuit.

68. A display module using a display device according to claim 58.

69. An electronic equipment using a display device according to claim 58.

70. A method of driving a display device in which a plurality of pixels, each of the pixels having a light emitting element comprising at least one transistor, the method comprising:

driving the display device by switching between a first drive mode and a second drive mode for driving the light emitting element according to according to display contents, wherein the first drive mode is used when character information is to be displayed, and the second drive mode is used when a natural picture is to be displayed.

71. A method according claim 70, wherein the first drive mode is driving the light emitting element at a constant current.

72. A method according claim 70, wherein the first drive mode is driving the transistor of the light emitting element in a saturation region.

73. A method according to claim 70, wherein the first drive mode is a mode using analog current drive.

74. A method according to claim 70, wherein the first drive mode is a mode using digital time gradation.

75. A method according to claim 70, wherein the second drive mode is a mode using digital time gradation.

76. A device according claim 70, wherein the second drive mode is driving the light emitting element at a constant voltage.

77. A device according claim 70, wherein the second drive mode is driving the transistor of the light emitting element in a linear region.

78. A display device comprising:

a source signal line;

a pixel having a light emitting element, a first transistor of which gate is electrically connected to a gate signal line, and a second transistor of which gate is electrically connected to the source signal line through a source and a drain of the first transistor and of which source or a drain is electrically connected to the light emitting element;

an analog video signal line;

two power source lines;

a first switch provided for switching between a first drive mode for driving the second transistor in a saturation region and a second drive mode for driving the second transistor in a linear region;

a second switching circuit provided for electrically connecting the analog video line to the source line;

a third switching circuit provided for electrically connecting one of the power source lines to the source signal line;

a first line provided for operationally connecting the first switching circuit to the second switching circuit; and a second line provided for operationally connecting the first switching circuit to the third switching circuit through at least one latch circuit.

79. A display device according claim 78, wherein the first drive mode is analog current drive.

80. A display device according claim 78, wherein the first drive mode is digital time gradation.

81. A display device according claim 78, wherein the second drive mode is digital time gradation.

82. A display device according claim 78, wherein a potential change for drive mode switching is controlled by an external circuit.

83. A display device according to claim 78, wherein a third switching circuit comprise two switches.

84. A display device according to claim 78, wherein a potential change for drive mode switching is controlled by an external DA converting circuit.

85. A display device module using a display device according to claim 78.

86. An electronic equipment using a display device according to claim 78.

87. A display device comprising:

a source signal line;

a pixel having a light emitting element, a switching transistor electrically connected to the source signal line, and a driving transistor connected in series with the light emitting element;

an analog video signal line;

two power source lines;

a first switching circuit provided for switching between a first drive mode for driving the driving transistor in a saturation region and a second drive mode for driving the driving transistor in a linear region;

a second switching circuit provided for electrically connecting the analog video line to the source signal line;

a third switching circuit provided for electrically connecting one of the power source lines to the source signal line;

a first line provided for operationally connecting the first switch to the second switch; and a second line provided for operationally connecting the first switch to the third switch through at least one latch circuit.

88. A display device according to claim 87, wherein the first drive mode is analog current drive.

89. A display device according to claim 87, wherein the first drive mode is digital time gradation.

90. A display device according to claim 87, wherein the second drive mode is digital time gradation.

91. A device according to claim 87, wherein a potential change for drive mode switching is controlled by an external circuit.

92. A display device according to claim 87, wherein a third switching circuit comprises two switches.

93. A display device according to claim 87, wherein a potential change for drive mode switching is controlled by an external DA converting circuit.

94. An electronic equipment using a display device according to claim 87.

* * * * *